US005647157A

United States Patent [19]

Kasahara

[11] Patent Number: 5,647,157

[45] Date of Patent: Jul. 15, 1997

[54] TENSION PANEL

[75] Inventor: Keiji Kasahara, Kakegawa, Japan

[73] Assignee: Abisare Co., Ltd., Shizuoka, Japan

[21] Appl. No.: 425,470

[22] Filed: Apr. 20, 1995

[30] Foreign Application Priority Data

| | | | |
|---|---|---|---|
| Apr. 22, 1994 | [JP] | Japan | 6-85052 |
| May 27, 1994 | [JP] | Japan | 6-115620 |
| Sep. 13, 1994 | [JP] | Japan | 6-219115 |

[51] Int. Cl.[6] ..... G09F 1/12

[52] U.S. Cl. ..... 40/79.2; 40/603; 38/102.91

[58] Field of Search ..... 40/156, 603, 604, 40/792, 793; 160/329, 378; 38/102.91, 102.1, 102.2, 102.9; 101/127.1

[56] References Cited

U.S. PATENT DOCUMENTS

| | | | |
|---|---|---|---|
| 4,023,488 | 5/1977 | Zimmer | 101/127.1 |
| 4,028,832 | 6/1977 | Wu . | |

FOREIGN PATENT DOCUMENTS

| | | | |
|---|---|---|---|
| 132953 | 2/1985 | European Pat. Off. . | |
| 558342 | 9/1932 | Germany . | |
| 3403751 | 8/1985 | Germany . | |
| 223989 | 11/1924 | United Kingdom | 160/378 |

*Primary Examiner*—Kenneth J. Dorner
*Assistant Examiner*—Cassandra Davis
*Attorney, Agent, or Firm*—Rabin, Champagne & Lynt, P.C.

[57] ABSTRACT

A tension panel includes a frame, and a retaining device affixed to and retaining respective corners of a display sheet. A stretching and fixing assembly is provided which includes an L-shaped bar formed by two legs joined together to define a bent region of the bar. The legs each have a free end attached to the frame so that the bar is movable from a raised position, through an intermediate position, to a lowered position in which the bar lies essentially flush with the frame. The assembly further includes a resilient member having one end attached to the bent region of the bar, and another end attached to the retaining device for exerting a tensile force on the retaining device when the bar is in the lowered position. The tensile force extends in a direction along an imaginary line that divides an interior angle of the respective corner into two angles, so as to stretch and fix the display sheet on the frame. When the bar is in the raised position, the tensile force is not exerted. When in the intermediate position, the bar exhibits an unstable condition. When the bar is in a position that is between the intermediate position and the lowered position, a component of the tensile force urges the bar into the lowered position.

7 Claims, 49 Drawing Sheets

TENSION PANEL

BACKGROUND OF THE INVENTION

1. Field of the Invention

The present invention relates to a tension panel and more particularly to a tension panel on which display sheets such as posters and banners can be displayed, being stretched tight.

2. Description of the Prior Art

There are various known methods for displaying a poster on a panel. One example is the method shown in FIG. 50, in which a poster is displayed on a panel, and is stretched under tension. According to this method, the upper and lower ends of a poster 400 are pinched by grips 401. These grips 401 are pulled in the directions (i.e., upward and downward directions) of the arrows by adjusting a plurality of screws connected to an aluminum panel 406, so that the poster 400 is stretched. Another example is shown in FIG. 51, in which the grips 401 are pulled upwards and downwards by means of a plurality of springs 405, each of which is secured to the panel 406 at one end thereof, whereby the poster 400 is stretched and displayed on the panel 406.

The panel 406 has the property of expansion with a rise in temperature, while the poster 400 has the property of expansion with a rise in humidity because it is made of paper, and temperature does not rise in proportion to humidity in the normal environment, so that the poster 400 tends to crease with time. More precisely, the poster 400 shown in FIG. 50 gets creases 402 in the areas retained by the grips 401 as shown in the figure, after a specified time has elapsed. It also gets curls 403 on its sides, which are not retained by the grips 401, and a vertically extending wavy line 404 at the center. The poster 400 shown in FIG. 51 gets less curls 403 but more wavy lines 404. Many creases 402 are created especially when humidity is high.

To prevent the formation of wavy lines 404, the sides of the poster 400 shown in FIG. 51 are further pinched at their middle parts by other grips 401*a* and pulled by springs 405*a* as shown in FIG. 52. With this method, the vertically extending wavy lines 404 are not formed, but obliquely extending wavy lines 404*a* are made, drawing a substantially diamond shape in the neighborhood of the four corners. Another improved method is such that the upper and lower ends of the poster 400 are retained at their respective lateral ends by means of grips 401*b* that are pulled upwards and downwards by the springs 405, as shown in FIG. 53. With this method, although the wavy lines 404 and curls 403 are not present, the creases 402 are inevitably formed in the areas retained by the grips 401, after the elapse of a specified time.

All of the above-described conventional methods disadvantageously take time in setting a poster and therefore there has been a strong demand for a quick displaying method.

SUMMARY OF THE INVENTION

The invention has been made in consideration of the foregoing problems and therefore one of the objects of the invention is to provide a tension panel on which display sheets, such as posters or banners, can be displayed without getting creases, wavy lines or curls even if the temperature or humidity changes as time elapses. Another object of the invention is to provide a tension panel on which display sheets can be displayed by a simple process.

These objects can be achieved by providing a tension panel according to the invention, comprising:

(a) a frame;

(b) stretching and fixing means attached to the frame; and (c) retaining means for retaining the corners of a display sheet, wherein the stretching and fixing means exerts tension on the retaining means such that the tension is directed outwardly from the display sheet in the extending directions of imaginary lines each of which divides the interior angle of each corner of the display sheet into two, whereby the retaining means is fixed, being stretched.

According to such a tension panel, tension is exerted in the extending directions of imaginary lines each of which divides the interior angle of each corner of the display sheet into two so that the display sheet is stretched both vertically (upwards and downwards) and laterally (rightwards and leftwards). Tension is exerted on opposed corners such that tensile forces working on the corners are well balanced, which allows the display sheet to be stretched without warping. In the examples shown in FIGS. 50 and 51, as the upper and lower ends are entirely pulled, the wavy lines 404 and curls 403 are formed. Unlike these examples, only a part of each corner of the display sheet is pulled in the invention so that the wavy lines 404 and curls 403 are not formed. The vertically extending wavy lines 404 are generally created by expansion and contraction in a lateral direction, and in the invention, the wavy lines 404 caused by expansion and contraction are prevented by pulling the display sheet laterally. In the examples shown in FIGS. 50, 51 and 53, the grips 401 and 401*b* are pulled only in vertical directions, which causes the creases 402, while the display sheet of the invention is pulled both vertically and laterally (namely, upwards, downwards, rightwards and leftwards) at the corners so that the creases 402 are not formed.

In the tension panel of the invention, the stretching and fixing means may comprise (a) fixing means attached to the frame and (b) resilient members each having an end attached to the fixing means and another end attached to the retaining means. With this arrangement, tension is not simply exerted by screws like the example of FIG. 50, but tension having flexibility is exerted by the resilient members so that warping forces which are caused by changes in temperature and humidity and imparted to the display sheet can be reduced, by being absorbed by the resilient members. As a result, the creation of wavy lines, creases and curls is prevented. In addition, as flexible tension by the resilient members is directed upwards, downward, rightwards and leftwards, warping forces working in both vertical directions and lateral directions caused by changes in temperature and humidity are absorbed to form a well balanced condition irrespective of the magnitude of each warping force. Furthermore, since the tension exerted on the corners is well balanced, the display sheet can be automatically and accurately placed on the center of the panel.

In the tension panel of the invention, the fixing means may be composed of L-shaped bars which can be brought from a predetermined raised state into a lying state in which each bar lies along the frame. Each resilient member is attached to the bent portion of each L-shaped bar such that when the L-shaped bars are in their raised state, no tensile force is exerted on the display sheet. There is an unstable state between the raised state and lying state, and the L-shaped bars may be attached to the frame at both ends thereof such that when the L-shaped bars are in a state intermediate between the above unstable state and lying state, part of the tensile force of each resilient member to be exerted on the display sheet becomes a component force for forcing each L-shaped bar down into the lying state.

With such arrangement, the resilient members in a loose condition can be respectively attached to the bent portions of the L-shaped bars in the raised state, and then tension is exerted on the display sheet by forcing the L-shaped bars down into the lying state, so that the display sheet can be easily displayed on the panel. It is to be understood that when the L-shaped bars are in the lying state, load is exerted on the L-shaped bars to press them down, so that the L-shaped bars will not rise into the raised state by themselves.

The fixing means may include wires and wire winding means. The wires are connected to the resilient members and can be wound by the wire winding means, whereby the resilient members are pulled, exerting tension on the display sheet. With this arrangement, tension can be exerted on the corners of the display sheet by winding the wires with the wire winding means after the display sheet on which no tension is exerted has been placed in a desired position. This enables easy setting of the display sheet. The fixing means may be designed as sliding members each of which is attached with the resilient member and can slide from a position where the resilient member attached is not pulled to a position where the resilient member is pulled, exerting tension on the display sheet. In this case, tension can be exerted on the display sheet by sliding the sliding members, after the display sheet subjected to no tension has been placed in a desired position. This also facilitates setting of the display sheet.

In the tension panel of the invention, the stretching and fixing means may be composed of L-shaped resilient assemblies and both ends of each resilient assembly are attached to the frame, and the retaining means may be attached to the respective bent portions of the L-shaped resilient assemblies. Each of the L-shaped resilient assemblies pivots on an axis connecting both ends thereof from a raised state to a lying state in which the L-shaped resilient assembly lies along the frame. No tension is exerted on the display sheet when the L-shaped resilient assemblies are in their raised state. There is an unstable state between the raised state and lying state, and the L-shaped resilient assemblies may be attached to the frame such that when the L-shaped resilient assemblies are in a state intermediate between the unstable state and lying state, part of the tensile force of each L-shaped resilient assembly to be exerted on the display sheet becomes a component force for forcing the L-shaped resilient assembly down into the lying state.

In this case, each L-shaped retaining member is attached to the bent portion of each L-shaped resilient assembly in the raised state on which no stress is exerted, and then tension is exerted on the display sheet by forcing the L-shaped resilient assemblies down into the lying state, so that the display sheet can be easily displayed on the panel. It is to be understood that when the L-shaped resilient assemblies are in the lying state, load is exerted on the L-shaped resilient assemblies to force them down, so that the L-shaped resilient assemblies will not rise into the raised state by themselves.

The retaining means may be holders stuck to the corners of the display sheet to retain them or clips for pinching the corners of the display sheet. The retaining means may be L-shaped retaining members formed from leaf springs. Each L-shaped retaining member may be formed by diagonally bending a square material which is obtained by stamping out the center square portion of a square leaf spring.

In the tension panel of the invention, the imaginary lines each dividing the interior angle of each corner of the display sheet into two may be bisectors each of which bisects the interior angle of each corner of the display sheet. That is, it is preferable, in view of the balance of tension, to exert tension on the corners of the display sheet in the extending directions of bisectors each of which bisects the interior angle of each corner of the display sheet.

Examples of the display sheet in the invention are posters and banners.

Other objects of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and accompanying drawings which are given by way of illustration only, and thus are not limitative of the present invention, and wherein:

FIGS. 1(*a*) and 1(*b*) are plan views of a tension panel for posters according to a first embodiment of the invention;

FIGS. 2(*a*) and 2(*b*) are enlarged views showing the attaching condition of springs of the panel shown in FIG. 1;

FIG. 3 is a plan view of a tension panel for posters according to a modification of the first embodiment;

FIGS. 4(*a*) to 4(*c*) show the fixing condition of a corner metal fitting 5 of the panel shown in FIG. 1;

FIG. 5 is a sectional view of a self-adhesive tape stuck to the corner metal fitting;

FIG. 6 is a plan view of the corner metal fitting;

FIGS. 7(*a*) and 7(*b*) are partial plan views of a tension panel for posters according to another modification of the first embodiment;

FIG. 8 is a perspective view of an L-shaped bar which serves as the stretching and fixing means of a tension panel according to a second embodiment of the invention;

FIG. 9 is a perspective view of the L-shaped bar shown in FIG. 8, in a lying state;

FIG. 10 is a perspective view of a corner metal fitting serving as retaining means;

FIG. 11 is a perspective view of the tension panel of the second embodiment in which a poster is about to be set;

FIG. 12 is a perspective view of the tension panel shown in FIG. 11 in which a poster has been set;

FIG. 13 is a perspective view of the tension panel shown in FIG. 12 covered with decorative frames;

FIGS. 14(*a*) and 14(*b*) show another form of the corner metal fitting;

FIGS. 15(*a*) to 15(*c*) illustrate still another form of the corner metal fitting;

FIG. 16 is a perspective view of one form of a holder;

FIGS. 17(*a*) to 17(*c*) illustrate a process for setting a poster in the holder shown in FIG. 16;

FIG. 18 is a perspective view of a holder according to a modification of the second embodiment;

FIGS. 19(*a*) and 19(*b*) are perspective views of a holder according to another modification of the second embodiment;

FIGS. 20(*a*) and 20(*b*) are perspective views, and FIG. 20(*c*) is a side view of a holder according to a further modification of the second embodiment;

FIGS. 21(*a*) to 21(*c*) are perspective and side views of a holder according to a still further modification of the second embodiment;

FIG. 22 is a perspective view of a holder according to a still further modification of the second embodiment;

FIGS. 23(*a*) and 23(*b*) illustrate a process for setting a poster in the holder shown in FIG. 22;

FIG. 24 is a front view of a tension panel according to a third embodiment of the invention;

FIGS. 25(*a*) and 25(*b*) are enlarged views of stretching and fixing means incorporated in the tension panel shown in FIG. 24;

FIGS. 26(*a*) and 26(*b*) show a tension panel according to a modification of the third embodiment;

FIG. 27 is a perspective view of an L-shaped retaining member incorporated in a tension panel according to a forth embodiment of the invention;

FIG. 28 is a side view of the L-shaped retaining member shown in FIG. 27;

FIG. 29 is a plan view of the L-shaped retaining member shown in FIG. 28;

FIG. 30 is a plan view of an L-shaped resilient assembly according to a modification of the forth embodiment;

FIG. 31 is a partial perspective view of the L-shaped resilient assembly shown in FIG. 30;

FIGS. 32(*a*) and 32(*b*) illustrate a leaf spring member constituting the L-shaped resilient assembly shown in FIG. 30;

FIG. 33 is a plan view of the L-shaped resilient assembly shown in FIG. 30, as it is arranged in a frame for posters;

FIG. 34 is a side view of the L-shaped resilient assembly and frame shown in FIG. 33;

FIG. 35 shows the dynamical balance of the L-shaped resilient assembly shown in FIG. 34;

FIGS. 36(*a*) and 36(*b*) are perspective views of an L-shaped resilient assembly in a lying state according to a fifth embodiment of the invention;

FIG. 37 is a perspective view of the L-shaped resilient assembly shown in FIGS. 36(*a*) and 36(*b*), as it is about to be raised from its lying state;

FIG. 38 is a perspective view of the L-shaped resilient assembly shown in FIGS. 36, as it is in a raised state;

FIG. 39 is a plan view of an L-shaped resilient assembly according to a sixth embodiment of the invention;

FIG. 40 is a partial enlarged view of the L-shaped resilient assembly shown in FIG. 39;

FIG. 41 is a side view of the L-shaped resilient assembly shown in FIG. 39;

FIG. 42 is a plan view of an L-shaped resilient assembly according to a modification of the sixth embodiment;

FIGS. 43(*a*) and 43(*b*) illustrate the L-shaped resilient assembly shown in FIG. 42, the assembly being viewed at a different angle;

FIG. 44 is a plan view of an L-shaped resilient assembly according to a still further modification of the sixth embodiment;

FIG. 45 is a side view of the L-shaped resilient assembly shown in FIG. 44;

FIG. 46 is a plan view of an L-shaped resilient assembly according to a still further modification of the sixth embodiment;

FIG. 47 is a side view of the L-shaped resilient assembly shown in FIG. 46;

FIG. 48 is a plan view of an L-shaped resilient assembly according to a still further modification of the sixth embodiment;

FIG. 49 is a side view of the L-shaped resilient assembly shown in FIG. 48;

DESCRIPTION OF THE PREFERRED EMBODIMENTS

Referring now to the accompanying drawings, tension panels according to preferred embodiments of the invention will be explained.

First Embodiment

Figure 1A:
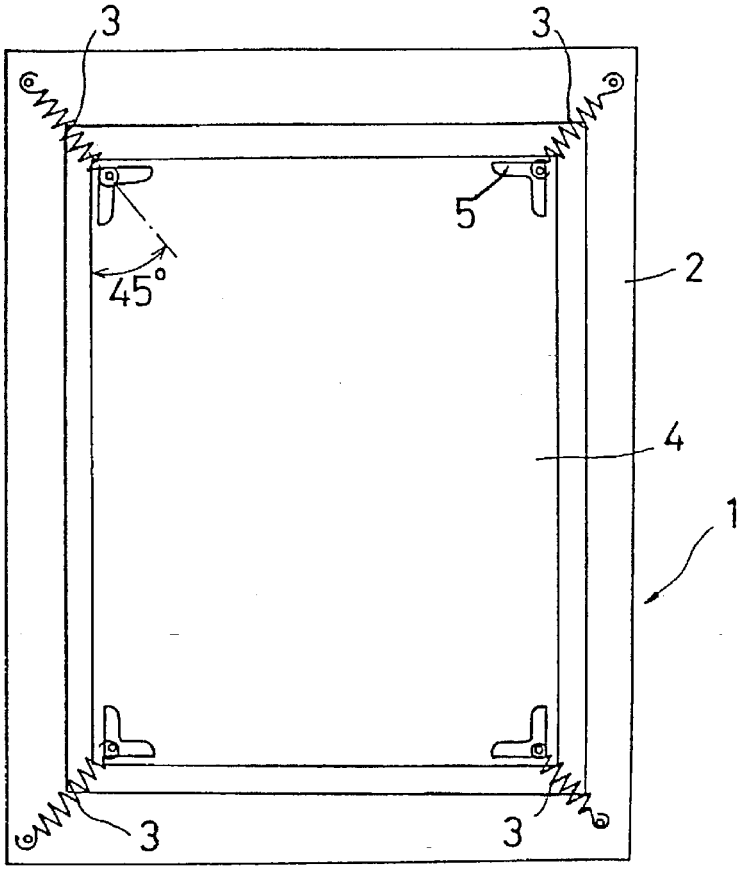
FIGS. 1 to 49 provide illustrations of tension panels according to embodiments of the invention.
Figure 1B:
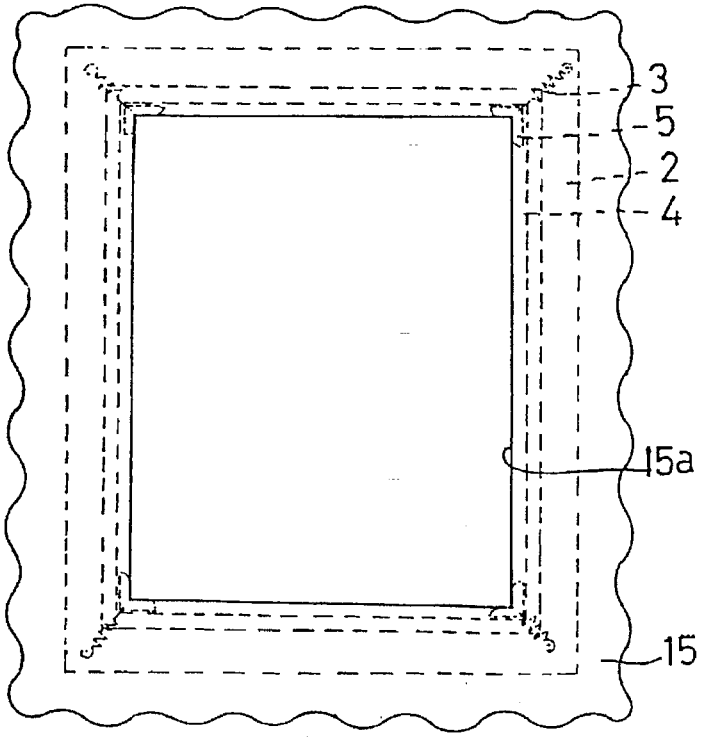

FIG. 1 shows a tension panel 1 according to a first embodiment of the invention. The tension panel 1 includes extension coil springs 3 disposed at the four corners of a frame 2. One end of each spring 3 is connected to a corner metal fitting 5 for retaining a corner of a poster 4. The corner metal fittings 5 are secured to the four corners of the poster 4 and pulled towards the corners of the frame 2 by means of the springs 3, whereby the poster 4 can be stretched without being creased. The springs 3 are stretched in the extending directions of bisectors each of which bisects the interior angle of each corner of the poster 4 by 45° when the poster 4 is displayed on the panel 1. The other end of each spring 3 opposite to the corner metal fitting 5 is attached to the frame 2. It is to be understood that FIG. 1(*a*) shows the back of the poster 4 and that when the panel 1 is hung up for displaying the poster 4, the front (i.e., the side opposite to the back of the panel shown in FIG. 1(*a*)) of the panel 1 is covered with a decorative frame 15 as shown in FIG. 1(*b*) and the face of the poster 4 can be seen through the opening of the decorative frame 15.

Figure 2A:
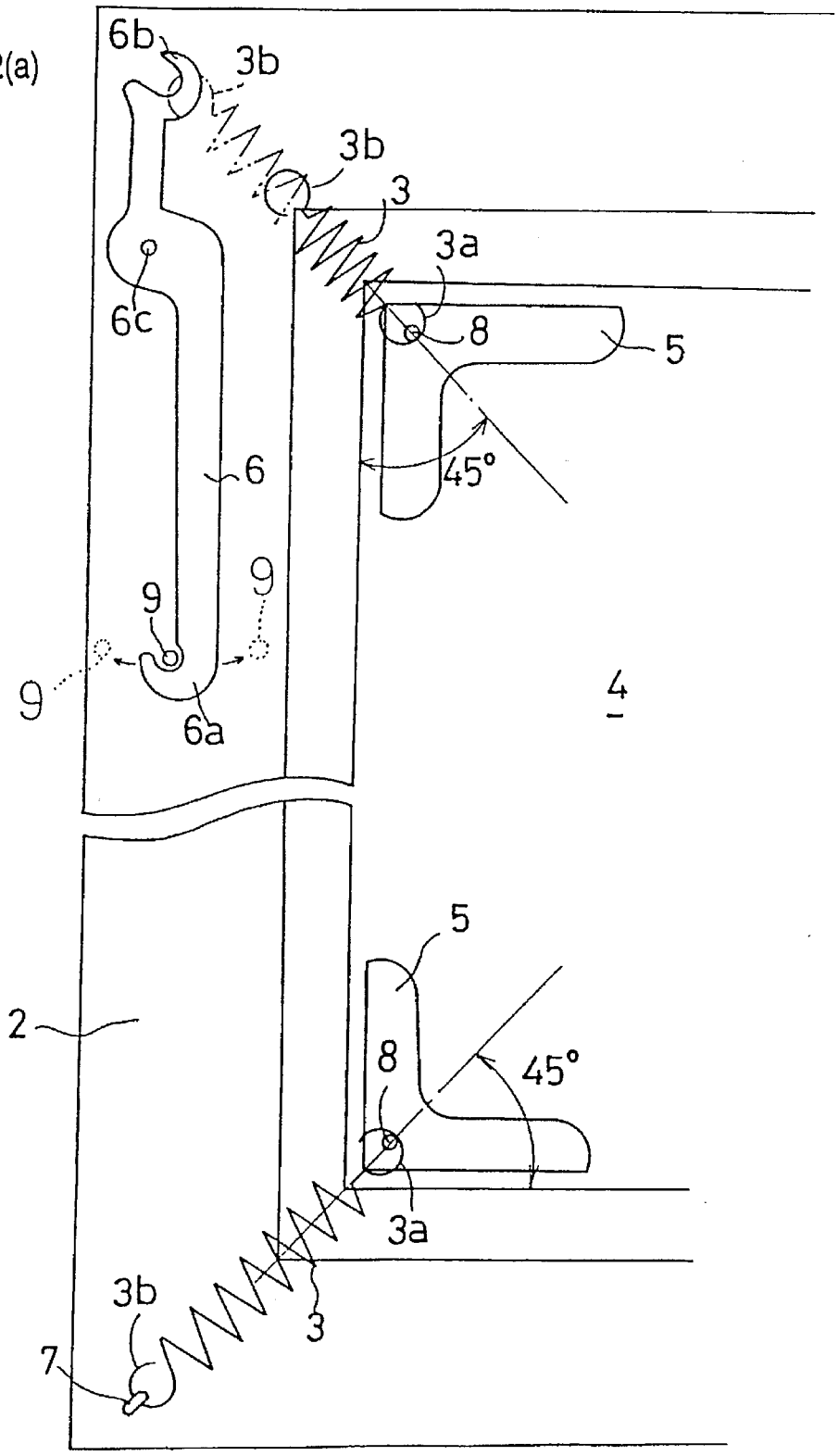
Figure 2B:
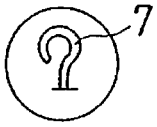

FIG. 2 shows in enlarged form how the springs 3 are attached in the tension panel 1. It is apparent from FIG. 2 that the attaching method for the upper springs 3 differs from that for the lower springs 3. Each of the upper springs 3 has, at one end, a hook portion 3*a* that is hooked over a catch 8 provided in the corner metal fitting 5. The other end of the upper spring 3 is provided with another hook portion 3*b* that is hooked over a retaining hook 6*b* provided at the upper end of an arm 6, so that the upper spring 3 can be stretched by rotation of the arm 6. More specifically, the arm 6 first rotates on a supporting point 6*c* to a position which is shifted clockwise from the position shown in FIG. 2 by about 90 degrees and then, the hook portion 3*b* of the upper spring 3 is hooked on the retaining hook 6*b*. Thereafter, when the arm 6 rotates counterclockwise on the supporting point 6*c* by about 90 degrees from the above position to the position shown in FIG. 2, the upper spring 3 is stretched as indicated by the dot chain line and a fixing part 6*a* positioned at the lower end of the arm 6 is hooked on a catch 9, thereby fixing the arm 6 and keeping the upper spring 3 in a stretched condition. Note that the position of the catch 9 can be changed as indicated by the arrows, whereby not only can the tension exerted on the corner metal fitting 5 be adjusted but also posters of various sizes can be accommodated in the tension panel 1.

Figure 3:
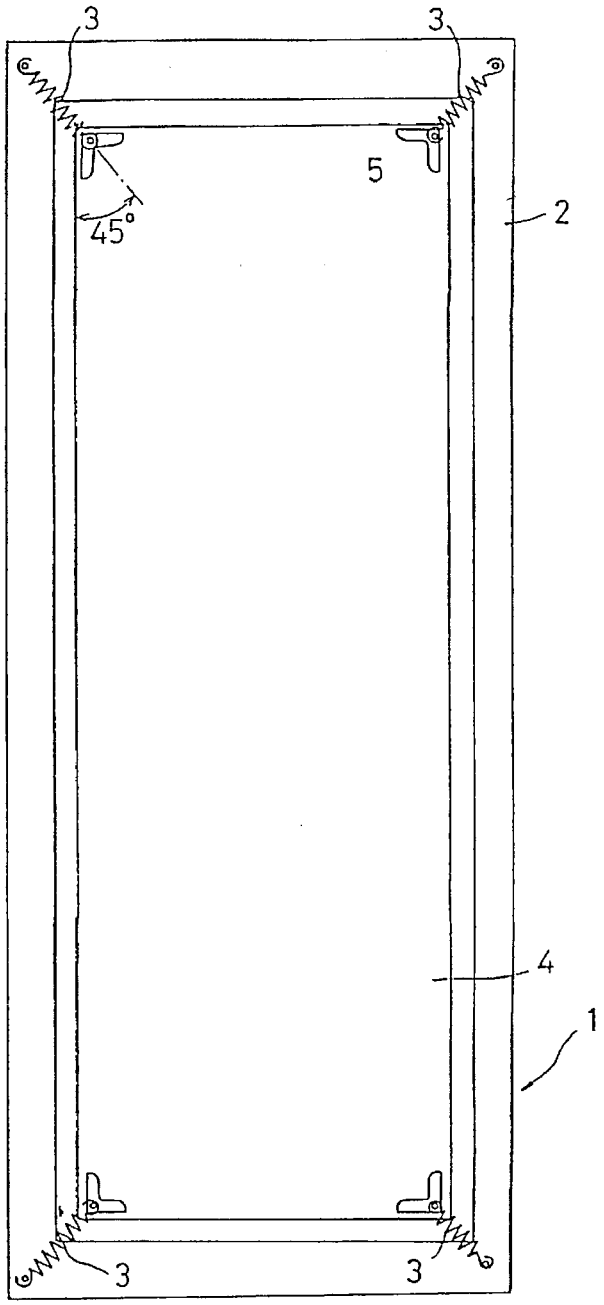

Each of the lower springs 3 has the hook portion 3*a* that is hooked on the catch 8 provided in the corner metal fitting 5 and the hook portion 3*b* that is hooked on a catch 7 disposed on the frame 2. The side view of the catch 7 is shown in FIG. 2(*b*). It is to be noted that the catch 7 may have the same configuration as those of the catches 8 and 9. In the attaching condition shown in FIG. 2(*a*), the upper and lower springs 3 are stretched in the extending directions of bisectors each of which bisects the interior angle (90°) of each corner of the poster 4. Therefore, the poster 4 is displayed on the frame 2, and is stretched by tension which is directed outwardly from the poster 4 in the directions of the bisectors. Even when the width/length ratio of the poster 4 is 1:3 or more as shown in FIG. 3, it is preferable that tension is exerted on the poster 4 in the extending directions of bisectors each bisecting the interior angle of each corner of the poster 4. In this embodiment, the springs 3, arms 6 and catches 7 constitute the stretching and fixing means.

The tensile force of each spring 3 when the poster 4 is displayed on the panel 1 depends on the material of the poster 4, but it is preferably in the range of about 1 to 2 kgs acceleration due to gravity (g). If the tensile force exceed 3 kgs (g), there is a likelihood that a problem will arise in attaching the corner metal fittings 5 to the poster 4 or that creases will be created on the poster 4. Although the tensile forces of the four springs 3 usually are equal to one another, if the poster 4 is heavy, the tensile forces of the upper springs 3 may be increased to keep a good balance. The material of the springs 3 is not limited to metals but could be a resin material such as POM, PSS or polycarbonate. Springs made from a resin are preferable as they are light and insusceptible to great fatigue and rust. In cases where a resin is used as the material of the springs 3, the resin may take the form of a hair-pin-like leaf spring.

Figure 4A:
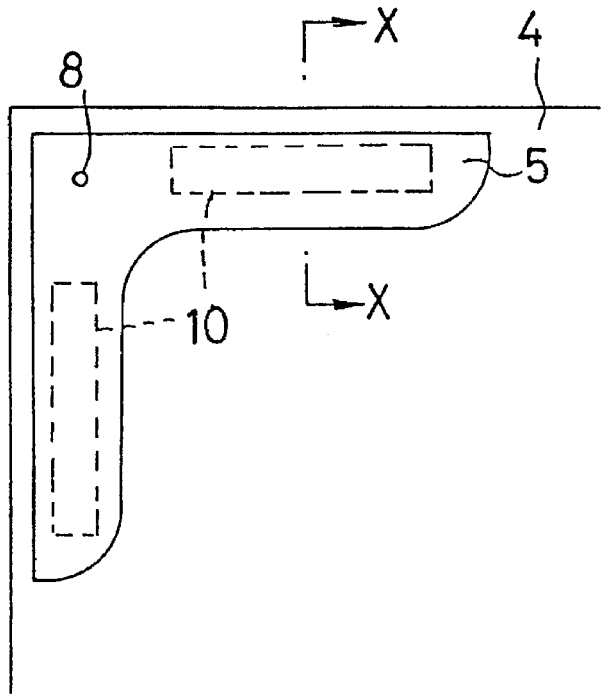
Figure 4B:
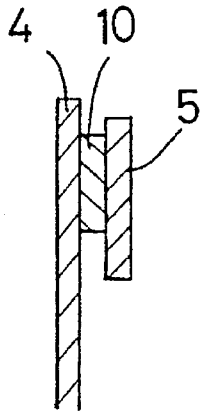
Figure 4C:
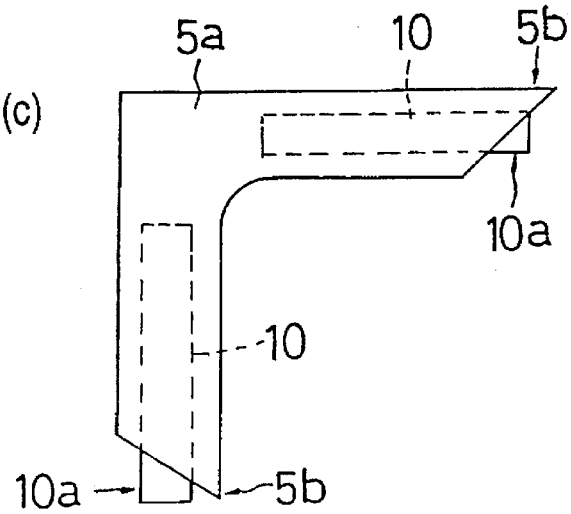

FIGS. 4(*a*) and 4(*b*) show the corner metal fitting 5 as it is fixedly attached to the poster 4. FIG. 4(*b*) is a section taken along line X—X of FIG. 4(*a*). As shown in these figures, the corner metal fittings 5 are attached to the corners of the poster 4 with the help of an adhesive double coated tape 10. Although the tension exerted by the springs 3 is a great force ranging from 1 to 2 kgs (g) as mentioned earlier, the poster 4 is unlikely to be torn out when such tension is exerted on the catches 8 by the springs 3. This is because the corner metal fittings 5 are made in the form of the character "L" and the display sheet 4 is supported by the arm faces of the L-shaped fittings 5 (more precisely, the faces of the tape 10) at areas along the sides of its corners. The tension exerted on a part of the poster 4 by each spring 3 is dispersed as a horizontal component force and a vertical component force so that creases and wavy lines are unlikely to be formed on the poster 4 even if the tension is in the range of 1 to 2 kgs (g). In the event that such great tension is concentrated on a part of the poster 4, the poster 4 would get creases and wavy lines at its corners.

Figure 5:
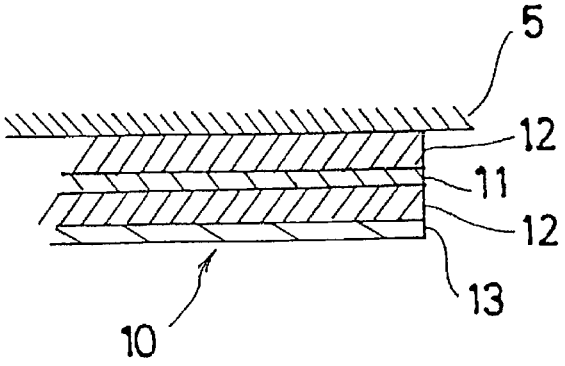

FIG. 5 shows the section of the self-adhesive tape 10 adhered to the corner metal fitting 5. The self-adhesive tape 10 used in this embodiment has the structure shown in FIG. 5, in which adhesive layers 12 are provided on both faces of a non-woven fabric 11. The tape 10 has a released paper sheet 13 stuck to the adhesive layer 12 before use. The tape 10 including the non-woven fabric 11 and both adhesive layers 12 is comparatively thick, having a thickness of 100 to 150 μm. Various adhesives can be used for the self-adhesive tape 10 but they must have bonding force greater than the tension exerted by the springs 3 (the bonding force should be e.g., 2 kgs (g) or more when measured by the "180°<peeling test" in accordance with JIS Z 1528). Adhesives containing acrylic alkyl ester copolymer are particularly preferable since they are resistant to high temperature and high humidity. Examples of the material of the corner metal fittings 5 are SUS, aluminum and iron. The adhesives can exhibit a high bonding force when used with these materials. The surface of these materials is preferably polished when used. It is also possible to use plastics such as ABS as the material of the corner metal fittings 5.

The corner metal fitting 5*a* whose ends are obliquely cut as shown in FIG. 4(*c*) may be used. In the case where the fittings 5*a* are used, the leading ends 10*a* of the self-adhesive tape 10 project from the corner metal fitting 5*a*. This example is advantageous in that when using the self-adhesive tape 10, the released paper sheet can be easily separated from the self-adhesive tape 10 by peeling off from the leading ends 10*a*. The obliquely cut ends of the corner metal fitting 5*a* form projections 5*b* which protect the leading ends 10*a* of the self-adhesive tape 10 so that the leading ends 10*a* are prevented from touching and sticking to other parts than specified sticking positions, during setting of the poster 4.

Figure 6:
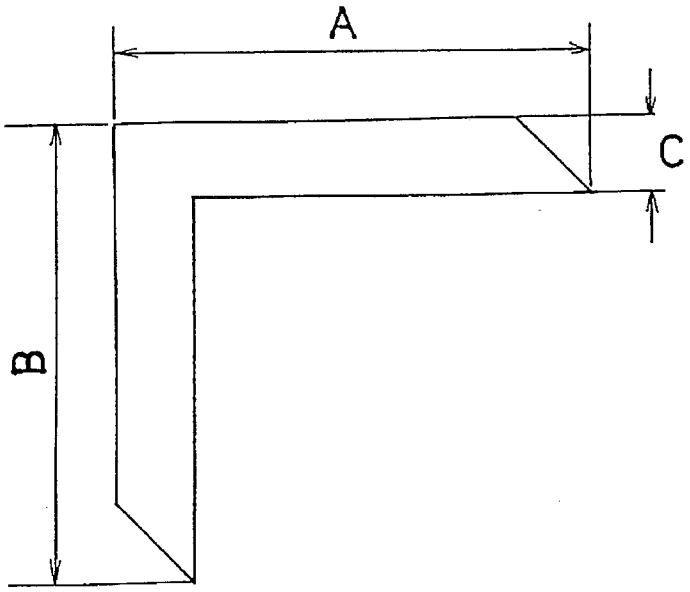

Although the size of the corner metal fittings 5, 5*a* is not particularly specified, the lengths A and B shown in the plan view of FIG. 6 are preferably in the range of 40 to 60 mm and the width C is preferably in the range of 5 to 10 mm, depending on the size of the poster 4 is B1 to B0, in view of the dispersion of tension. The thickness of the corner metal fittings 5, 5*a* is for example in the range of 1 to 2 mm.

After the above-described panel 1 on which the poster 4 was displayed had been left over one hour in an environment in which the temperature was 3° C. and relative humidity was 90%, no creases, wavy lines and curls were found on the poster 4.

Figure 7A:
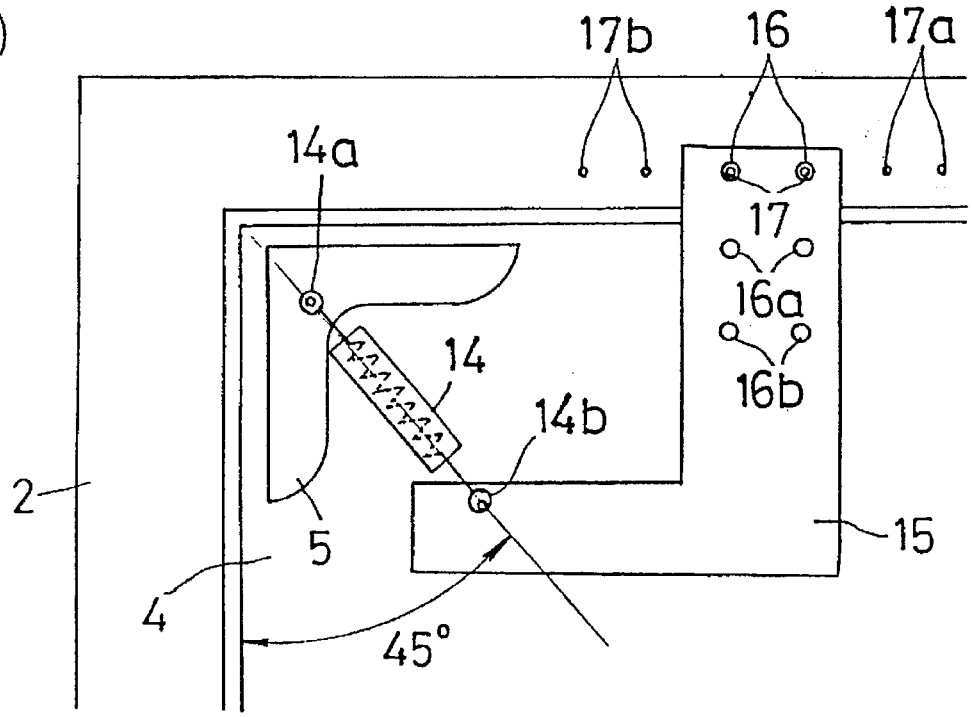
Figure 7B:
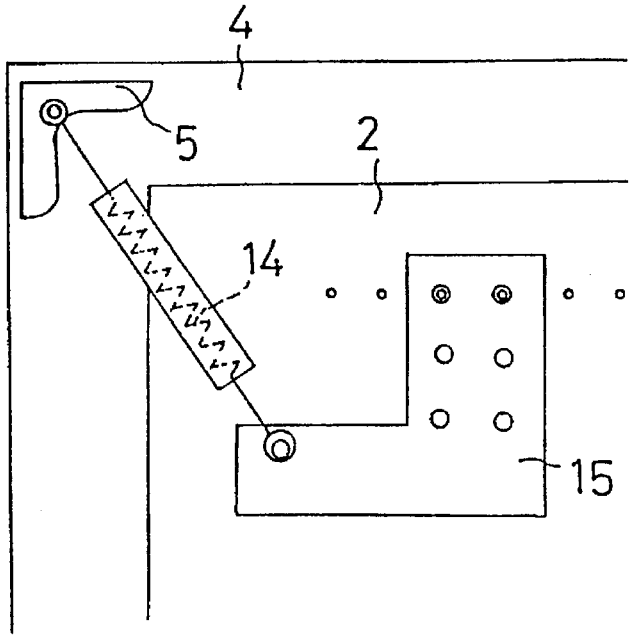

While the contraction forces of springs are utilized as tension for stretching a poster in the foregoing embodiment, it is also possible to utilize the expansion forces of springs for stretching a poster. Such an example is shown in FIG. 7(*a*). In this modified example, tension is exerted on the poster 4 by means of the corner metal fittings 5, L-shaped plates 15 and spring units 14 composed of compression coil springs. The corner metal fittings 5 are attached to the corners of the poster 4 like the foregoing embodiment, and the L-shaped plates 15 are attached to the frame 2. One end 14*a* of each spring unit 14 is attached to the corner metal fitting 5 while the other end 14*b* is attached to the L-shaped plate 15. The expansion forces of the spring units 14 are imparted to the corner metal fittings 5 and the corners of the poster 4 to which the corner metal fittings 5 are fixedly attached. In this example, each spring unit 14 is disposed so as to extend in the extending direction of a bisector which bisects the interior angle of a corner of the poster 4 by 45°. The poster 4 is attached to the frame 2, and is stretched by tension which is directed outwardly in the directions of the bisectors. Each corner metal fitting 5 disperses the force of each spring unit 14 as a horizontal component force and a vertical component force, just like the first embodiment.

Each of the L-shaped plates 15 is attached to the frame 2 by inserting projections 17 of the frame 2 into holes 16 of the L-shaped plate 15. The positions of the holes 16 and projections 17 may be changed. The holes 16 may be replaced by holes 16*a* or 16*b* and the projections 17 may be replaced by projections 17*a* or 17*b*, whereby posters 4 of various sizes can be displayed and the attaching angle of the spring units 14 can be adjusted.

In this modification, tension can be exerted on the poster 4, using the frame 2 which is smaller than the poster 4 as shown in FIG. 7(*b*).

According to the first embodiment and its modification described above, the magnitude and direction of tension exerted on the poster 4 can be adjusted in accordance with the material of the poster as well as environmental conditions such as temperature and humidity, and posters of different sizes can be displayed on the panel without getting creases, wavy lines and the like. In these examples, tension is exerted in the extending direction of the bisectors each of which bisects the interior angle of each corner of the poster 4. In other words, each bisector inclines at 45° with respect to one of the two sides forming the corner of the poster. However, even if imaginary lines each inclining at 40 to 50° with respect to one side of the corner (that is, the imaginary line inclines at 50 to 40° with respect to the other side) are employed in place of the bisectors, the balance of tension exerted on the poster will not be markedly upset and as a result, no creases, wavy lines and curls will be created. While tension is exerted on the poster by means of coil springs in the first embodiment and its modification, leaf springs, strings or straps made from rubber or a resin having elasticity may be used as the resilient members for exerting tension on the poster.

According to the first embodiment and its modifications, the tension exerted on the four corners of the poster is well balanced and therefore the poster can be displayed on the tension panel without getting creases, wavy lines and curls irrespective of the shape of the poster, even if temperature and/or humidity changes with time after setting of the poster. Furthermore, the well-balanced tension allows the poster to be automatically positioned upright in the center of the panel at the time of or after setting the poster.

Second Embodiment

Figure 8:
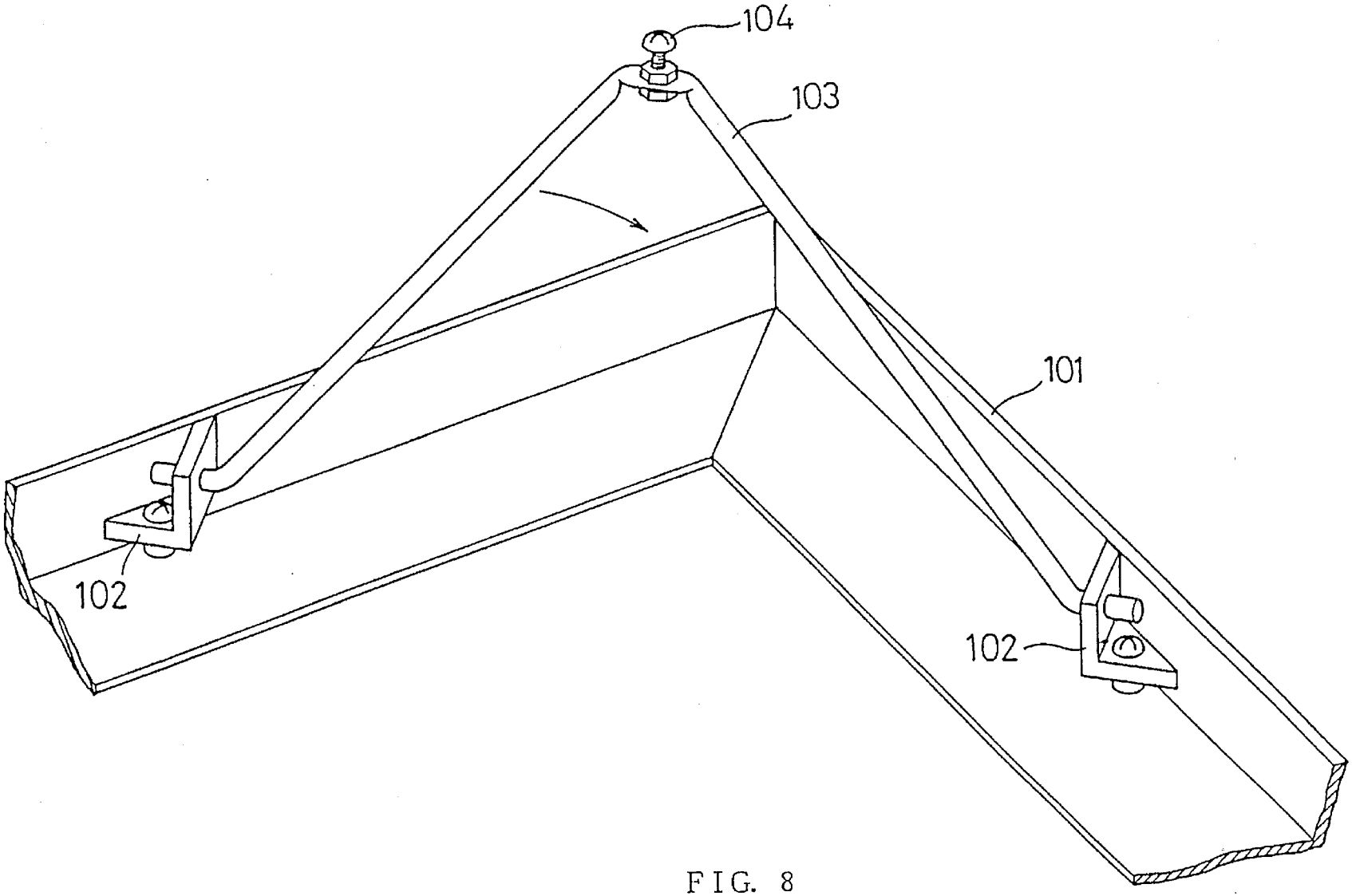
Figure 9:
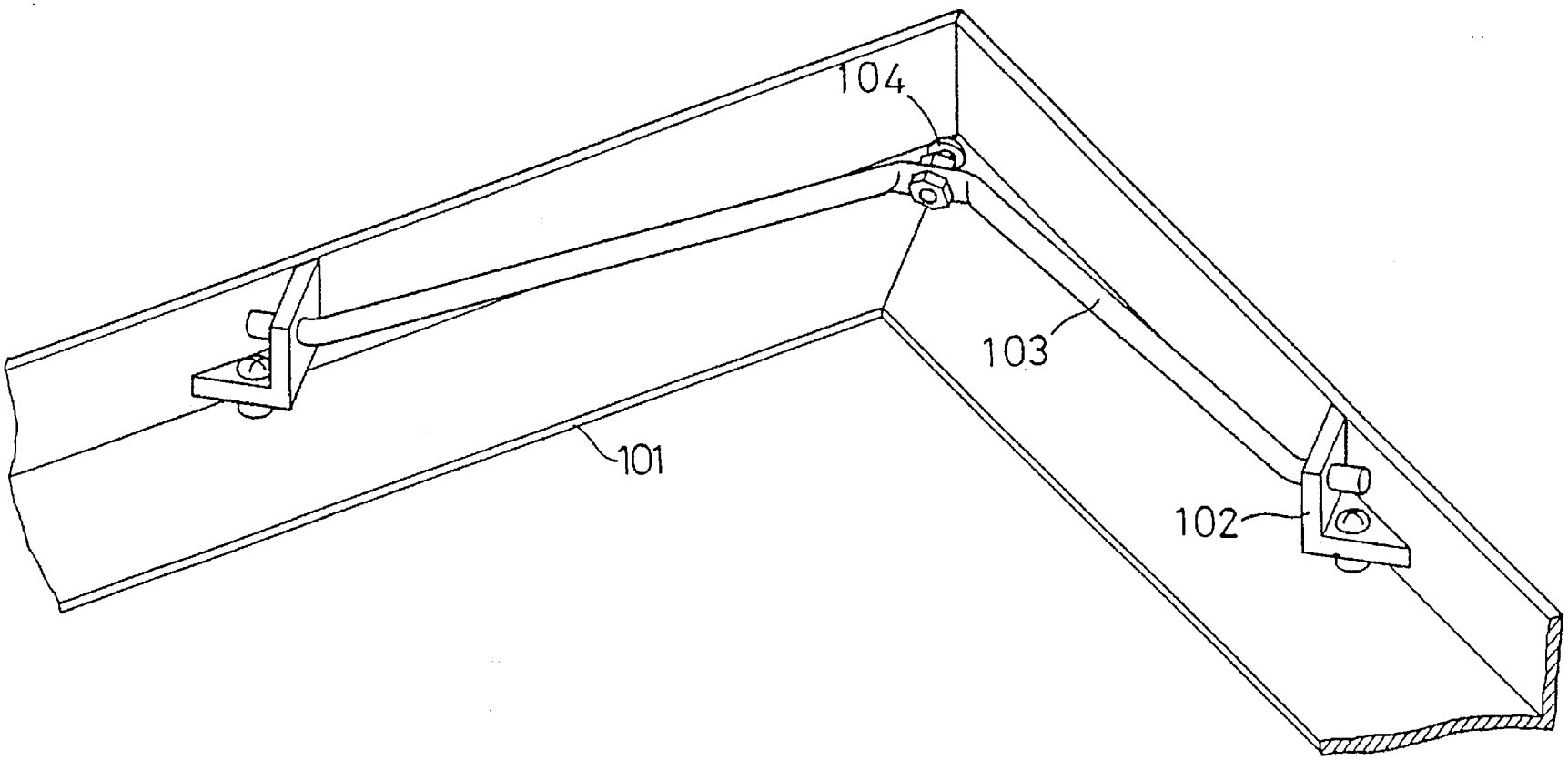

FIG. 8 shows a tension panel according to a second embodiment of the invention. In the second embodiment, there are provided L-shaped bars 103 working as the stretching and fixing means for resilient members described later. As shown in FIG. 8, both ends of each L-shaped bar 103 are pivotally attached to holders 102 secured to the frame 101. The L-shaped bar 103 is bent at the center. Disposed at the bent portion of the bar 103 is a catch 104 over which the resilient member (described later) is to be hooked. The L-shaped bar 103 can be collapsed in the direction indicated by the arrow in FIG. 8 and accommodated in the corner of the frame 101 as shown in FIG. 9.

Figure 10:
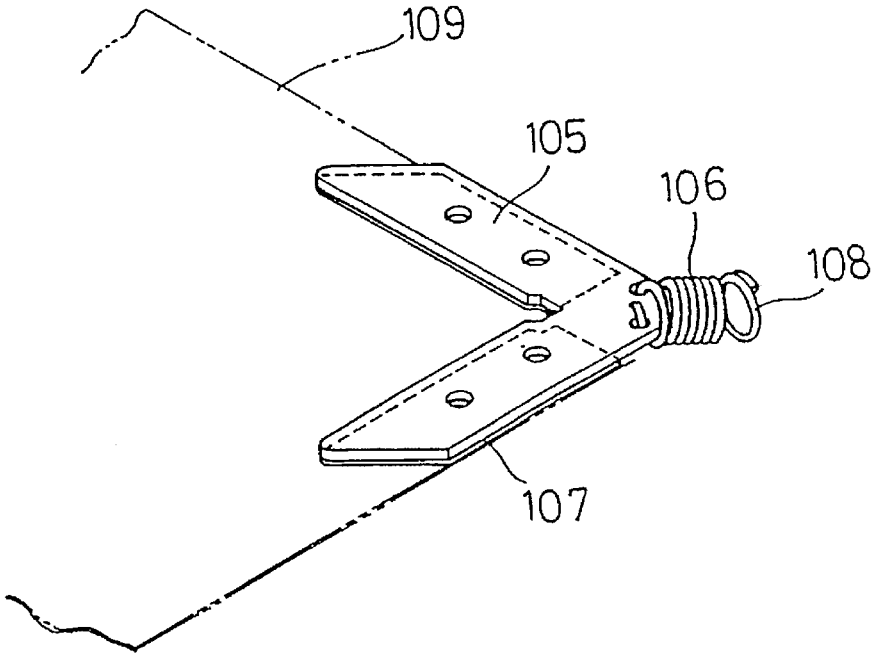

Next, retaining means for retaining the corners of the poster and resilient members for exerting a tensile force on the poster will be explained. FIG. 10 shows one form of the retaining means and resilient member. According to the second embodiment, the retaining means is composed of L-shaped corner metal fittings 105, and the bent part of each corner metal fitting 105 is attached to one end of an extension coil spring 106 serving as the resilient member, as shown in FIG. 10. The other end of the spring 106 is provided with a hook portion 108 which is to be hooked on the catch 104 of the L-shaped bar 103. The corner metal fittings 105 are affixed to the corners of a poster 109 by an adhesive 107.

Preferable examples of the adhesive 107 are adhesives containing acrylic alkyl ester copolymer, which are resistant against high temperature and high humidity. Examples of the material of the corner metal fittings 105 are SUS, aluminum and iron. The adhesives can exhibit high bonding force when used with these materials. The surface of these materials is preferably polished when used. It is also possible to use plastics such as ABS as the material of the corner metal fittings 105.

Figure 11:
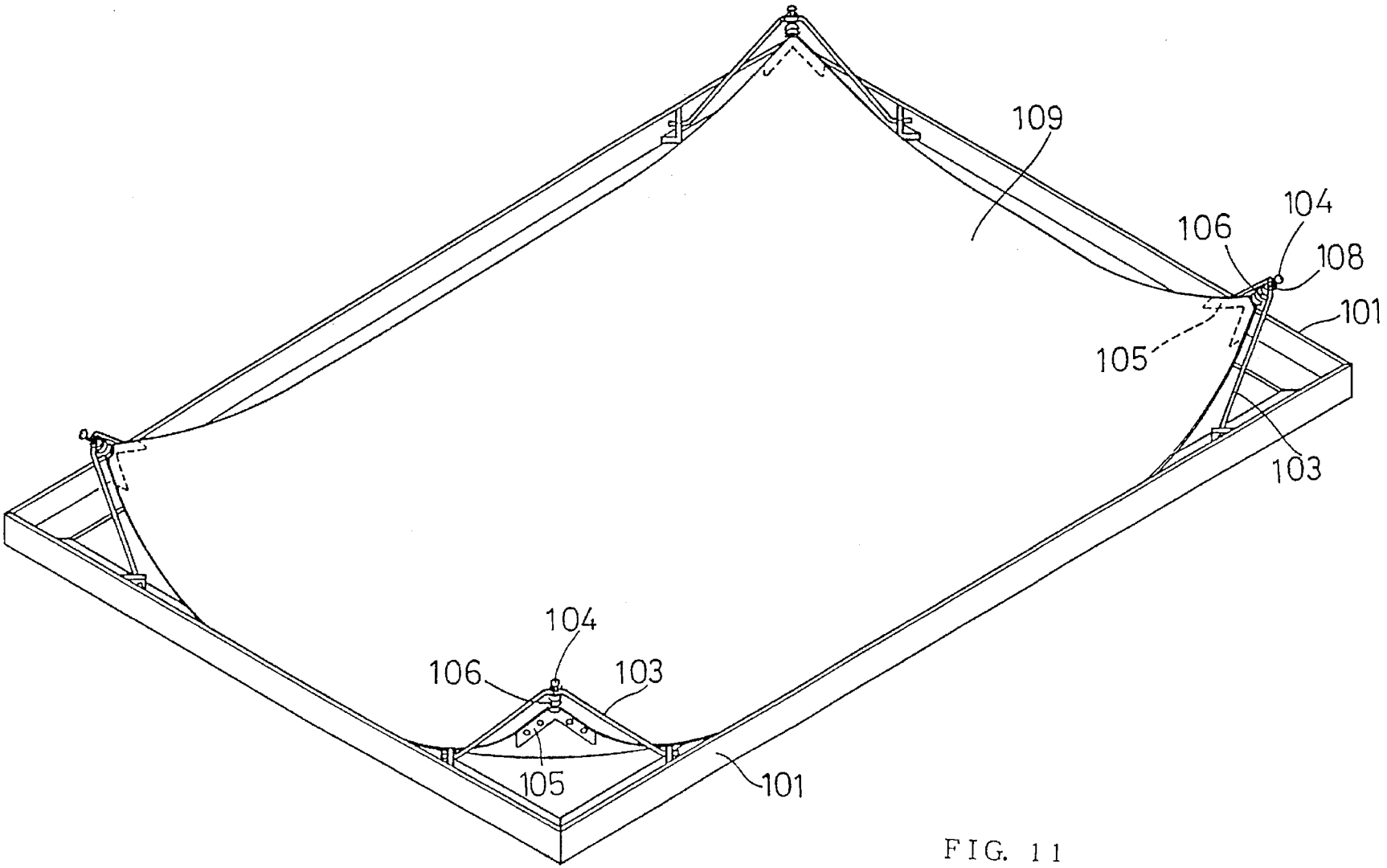
Figure 12:
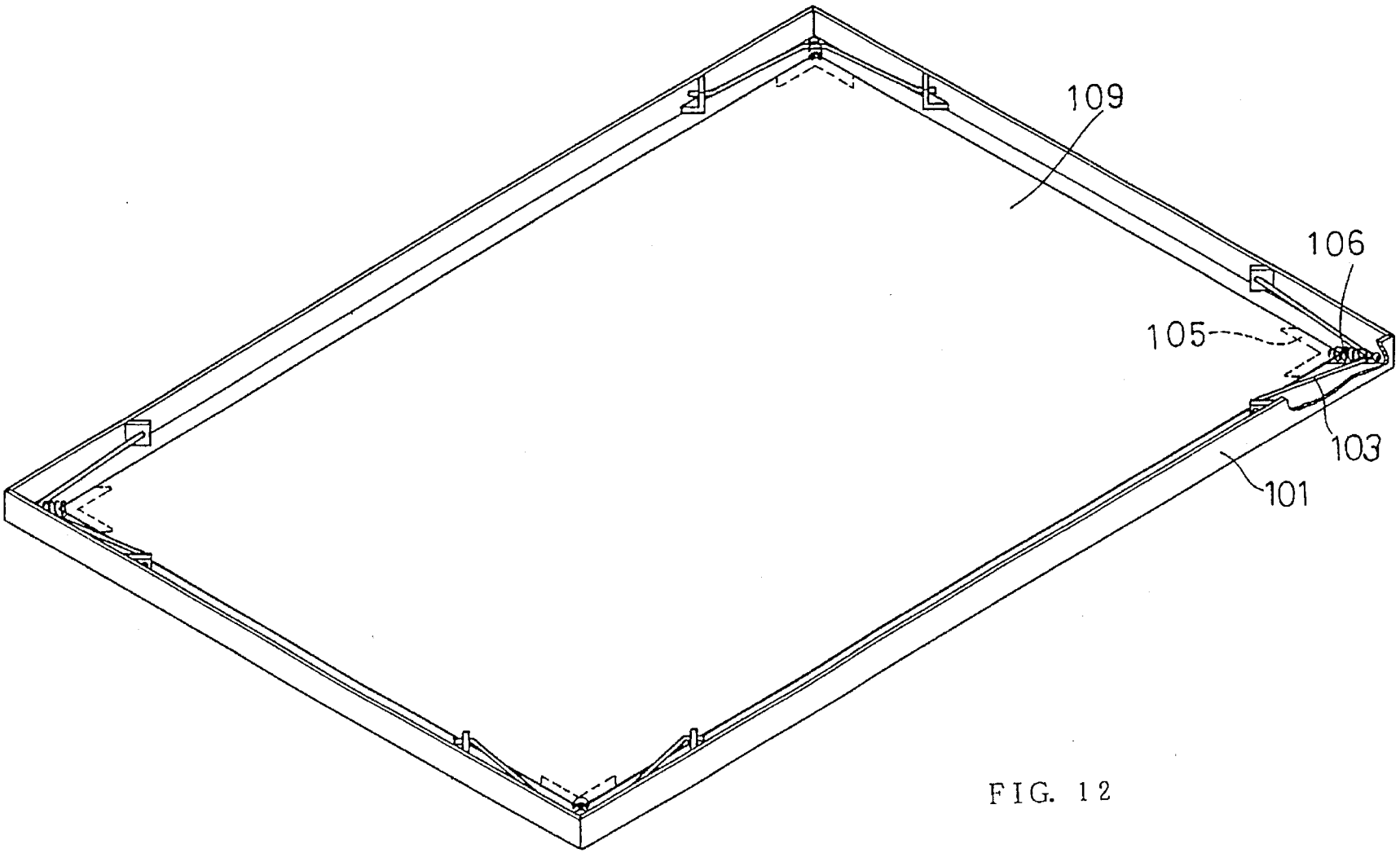

FIGS. 11 and 12 show the setting of the poster 109 in the frame 101, using the L-shaped bars 103, corner metal fittings 105 and springs 106. First, the corner metal fittings 105 are affixed to the four corners of the poster 109. Then, the hook portions 108 of the springs 106 attached to the corner metal fittings 105 are respectively hooked on the catches 104 of the L-shaped bars 103 which are in their raised state as shown in FIGS. 8 and 11. The size of the poster 109 corresponds to the inner periphery of the frame 101, but the poster 109 is in a loose state at this time because the four L-shaped bars 103 are raised as shown in FIG. 8 with no tensile force exerted thereon. Since the poster 109 is placed in the frame 101 in the loose state, setting of the poster 109 can be easily carried out. After setting, the L-shaped bars 103 are brought into their lying state shown in FIG. 9, thereby stretching the poster 109 as shown in FIG. 12. In a specified state (i.e., dead point) intermediate between the raised state shown in FIG. 8 and the lying state shown in FIG. 9, a maximum tensile force for the poster 109 is exerted on the L-shaped bars 103 through the springs 106. The tensile force then gradually decreases as the L-shaped bars 103 are brought into the lying state shown in FIG. 9. Specifically, when the L-shaped bars 103 are in a state between the dead point and the lying state, part of the tensile force exerted from each spring 106 onto the poster 109 becomes a component force for bringing each L-shaped bar 103 into the lying state. Once the L-shaped bars 103 are collapsed, they are pressed against the frame 101 and thereby fixed. The length etc. of the springs 106 is so adjusted that tension is exerted on the poster 109 when the L-shaped bars 103 are in their lying state. This permits the poster 109 to be stretched without being creased when it is in the state shown in FIG. 12. In this displayed state, the four springs 106 are stretched in the extending directions of bisectors each of which bisects the interior angle (90°) of each corner of the poster 109, and the poster 109 is displayed on the frame 101 receiving tension directed outwardly in the extending directions of the bisectors. Even when the width/length ratio of the poster 109 is 1:3 or more, the direction of the tension exerted on the poster 109 is preferably the same as the extending directions of the bisectors each bisecting the interior angle of each corner of the poster 109. The L-shaped bars 103 are pressed against the frame 101 as mentioned earlier, which allows the poster 109 to be stretched and inseparably attached to the frame 101.

Figure 13:
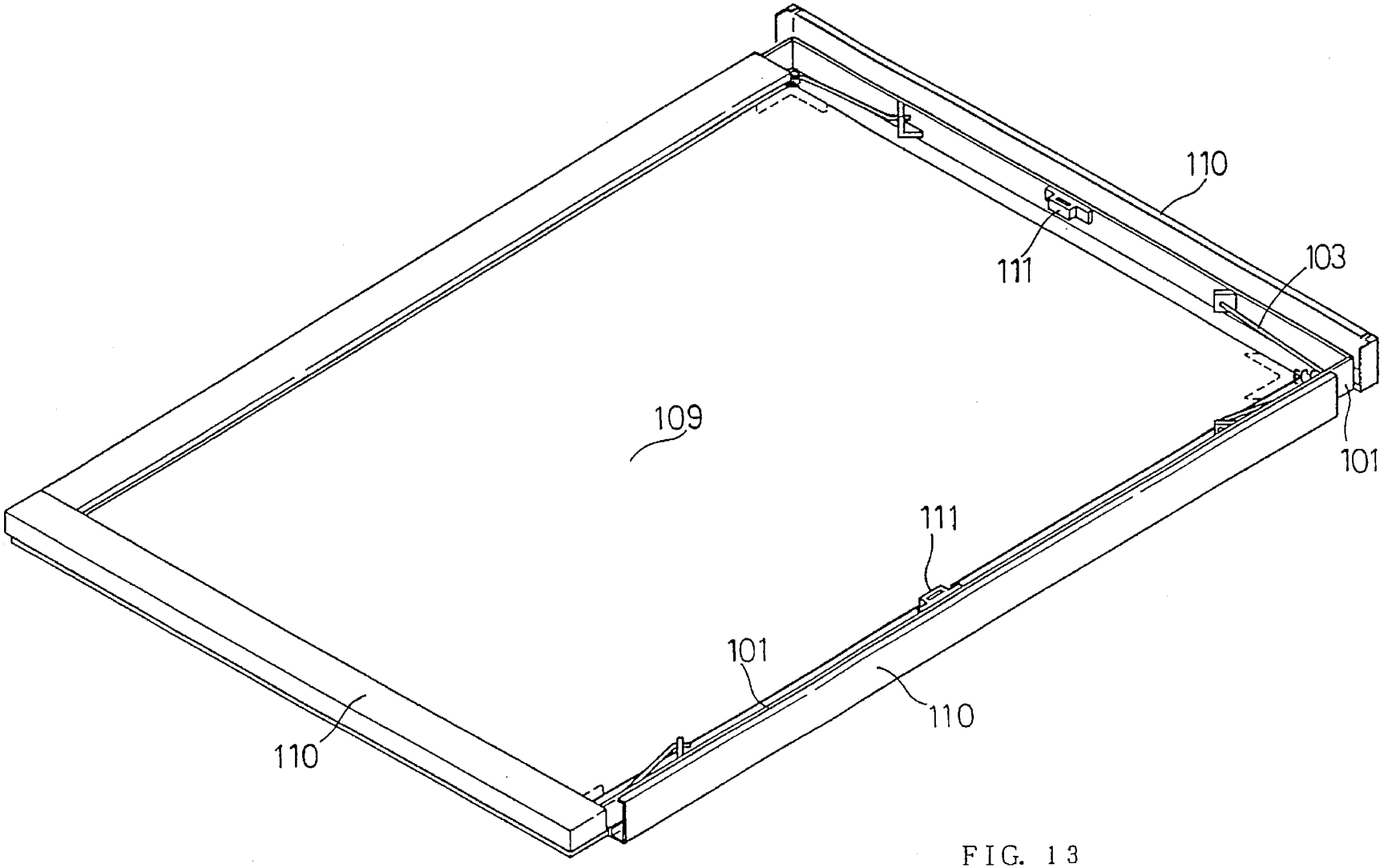

The frame 101 is provided with four decorative frames 110 as shown in FIG. 13. These four decorative frames 110 are pivotally attached to the sides of the frame 110 by means of hinges (not shown). With the help of the hinges, the decorative frames 110 can be opened and closed and when they are closed, the decorative frames 110 are secured to the frame 101 by magnets 111 which are respectively disposed at the center of each side of the frame 101. By closing the decorative frames 110, the frame 101 and the L-shaped bars 103 attached to the frame 101 are covered with these decorative frames 110 so that they are not seen from outside. Although the decorative frames 110 can be attached to the frame 101 at any stage, they are opened when setting the poster 109 in the frame 101.

Figure 14A:
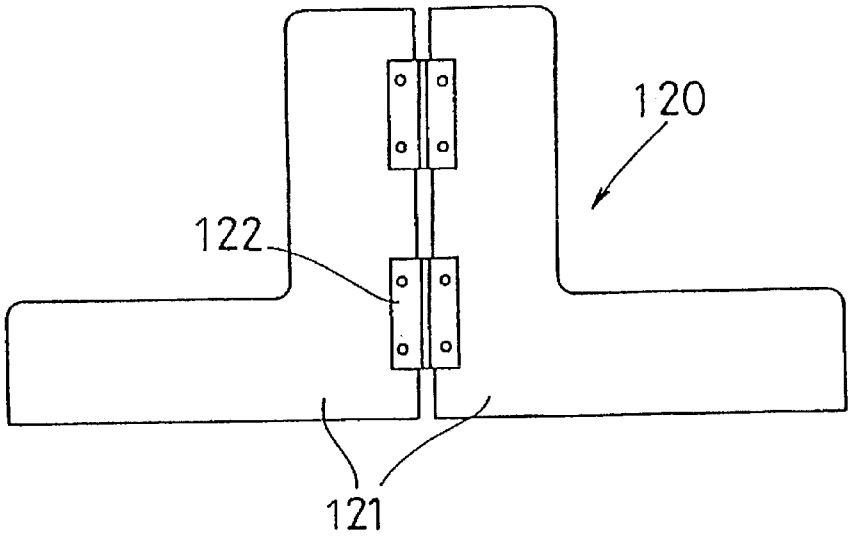
Figure 14B:
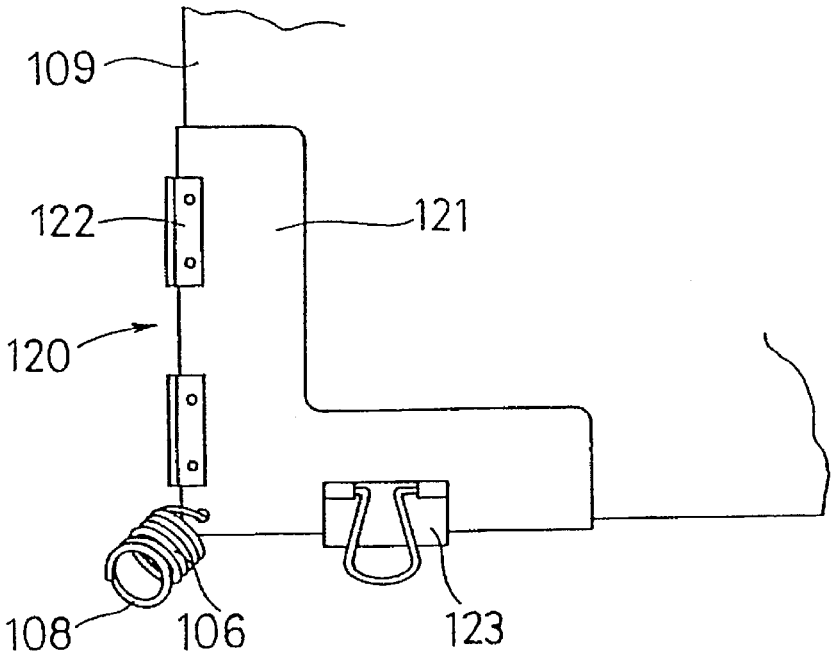
Figure 15A:
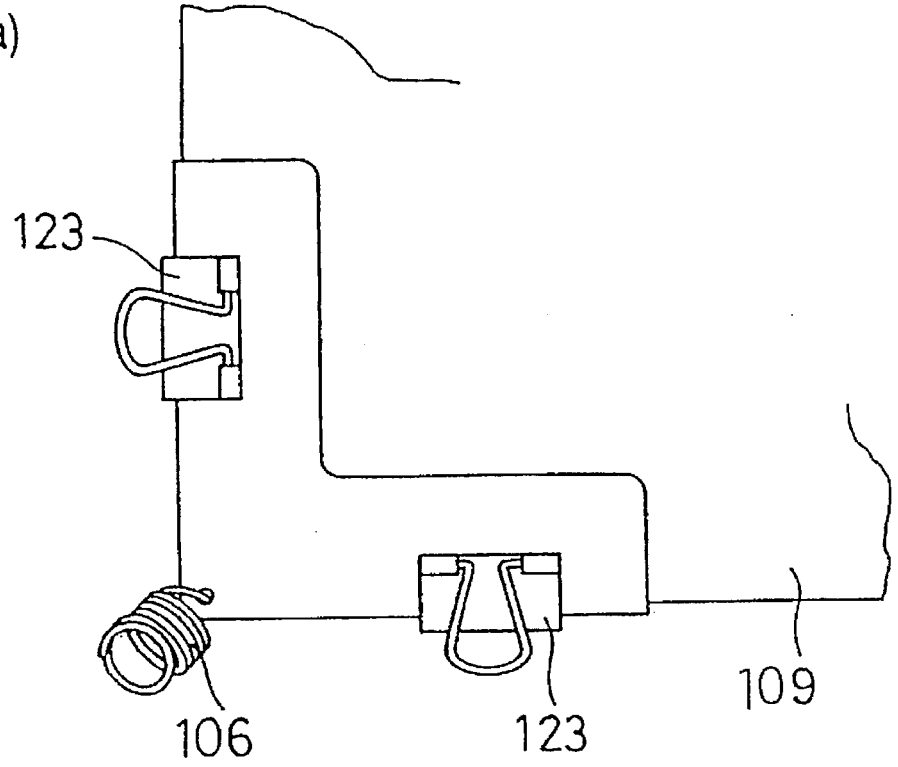
Figure 15B:
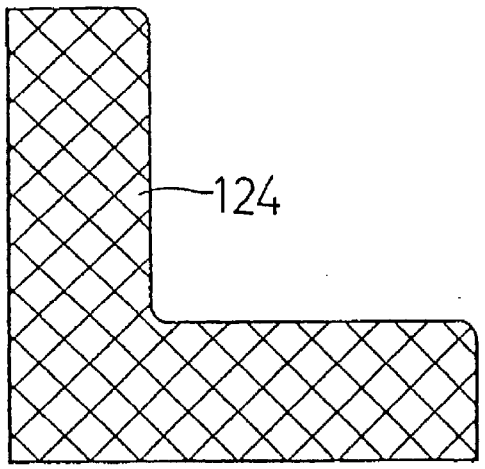

While the corners of the poster 109 are held by the corner metal fittings 105 using the adhesive 107 in the second embodiment, holders 120 as shown in FIGS. 14 may be used without adhesives. The holder 120 comprises two corner metal fittings 121 which are connected by hinges 122 as shown in FIG. 14(*a*). Each corner of the poster 109 is held between the two corner metal fittings 121 as shown in FIG. 4(*b*) and these fittings 121 are pinched by a double clip 123, whereby the poster 109 is held by the holder 120. Alternatively, the two corner metal fittings 121 are pinched by two double clips 123 without using hinges 122 as shown in FIG. 15(*a*), so that the poster 109 is held between the corner metal fittings 121. A corner metal fitting 124 shown in FIG. 15(*b*) is preferably used as the corner metal fitting, which has a coarse surface for preventing slippage of the poster 109.

Figure 16:
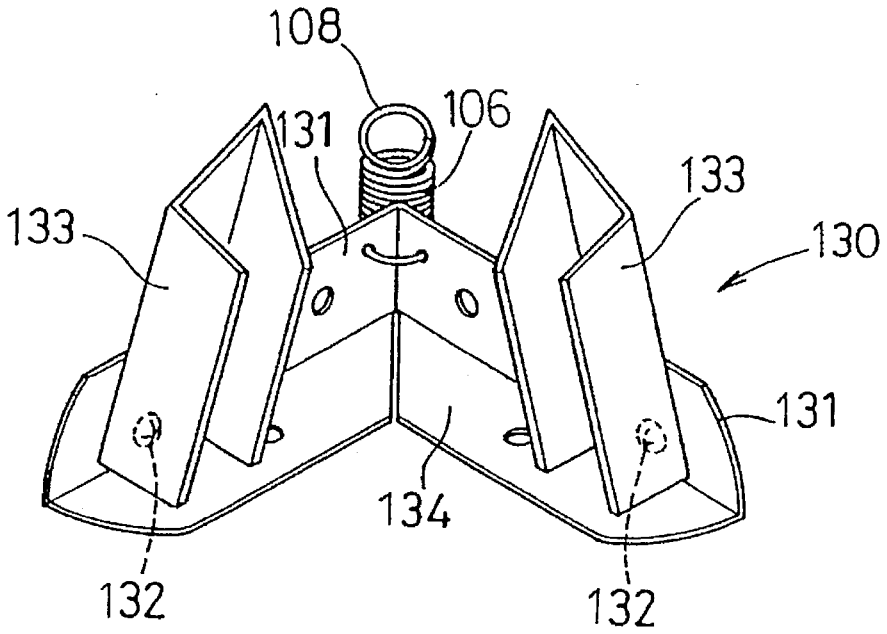

In the second embodiment, as the retaining means for retaining the corners of a poster, holders 130 as shown in FIG. 16 may be used in place of the retaining means described earlier. The holder 130 comprises a main body and two presser members 133. The main body is composed of a side wall face 131 bent in the form of an L and an L-shaped bottom face 134 that is so formed to correspond to the side wall face 131. The presser members 133 are rotatably attached to the side wall face 131 by means of shafts 132.

Figure 17A:
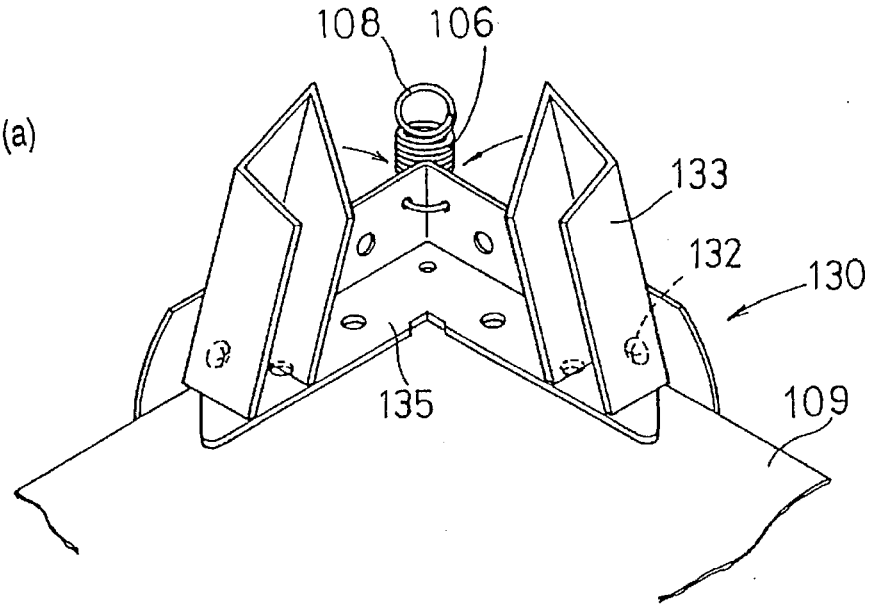
Figure 17B:
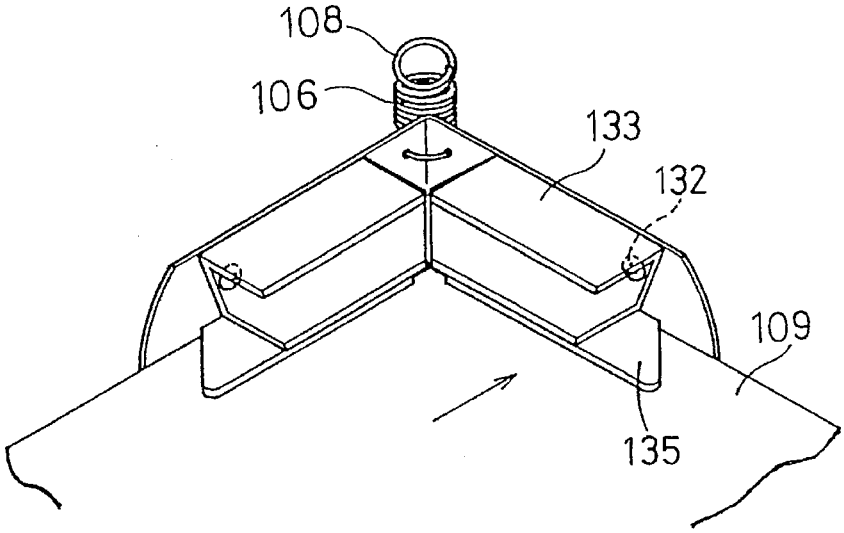
Figure 17C:
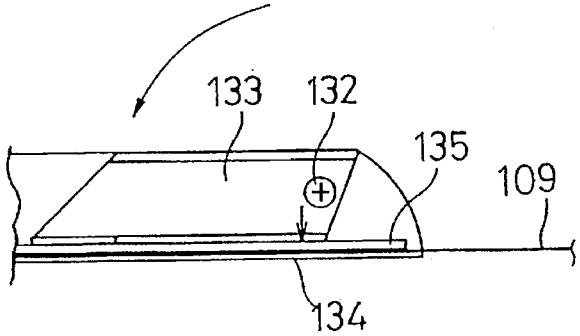

FIGS. 17 show the process for holding the poster 109 by the use of the holders 130. With the presser members 133 in their open state, each corner of the poster 109 is first placed over the bottom face 134 of the holder 130 as shown in FIG. 17(*a*) and then a corner metal fitting 135 is overlaid on the corner. Then, the presser members 133 are turned in the direction of the arrows so that the corner metal fitting 135 is pressed and fixed by the presser members 133 as shown in FIG. 17(*b*). Thus, the poster 109 is held between the bottom faces 134 of the holders 130 and the corner metal fittings 135. FIG. 17(*c*) shows the side view of the holding condition of FIG. 17(*b*) viewed in the direction of the arrow of FIG. 17(*b*). It is to be understood from FIG. 17(*c*) that the shaft 132 is positioned higher than the middle position of the width of the presser members 133 and that when the presser members 133 are collapsed as shown in FIG. 17(*b*), the underside of each member 133 presses the corner metal fitting 135 down.

Figure 18:
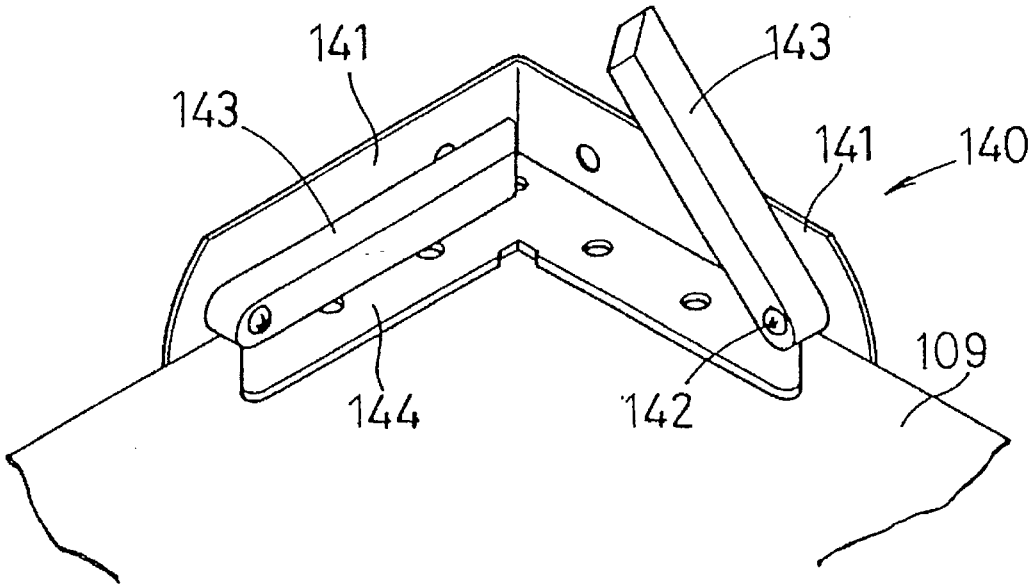

FIG. 18 shows a holder 140 having a similar structure to that of the holder 130. The holder 140 has a main body composed of an L-shaped side wall face 141 and L-shaped bottom face (not shown) corresponding to the side wall face 141, and two presser members 143 rotatably attached by shafts 142. The presser members 143 are solid while the presser members 133 described earlier are hollow. The holders 140 hold the poster 109, using corner metal fittings 144 just like the case of the holders 130.

Figure 19A:
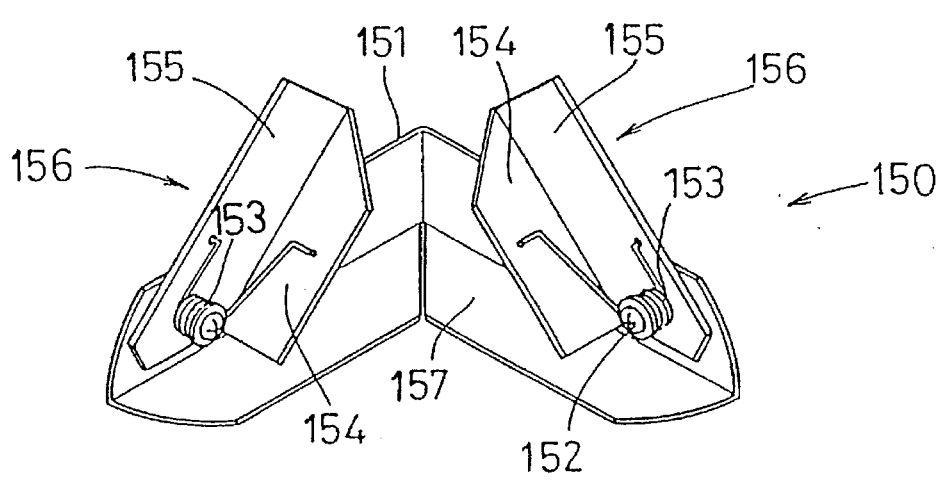
Figure 19B:
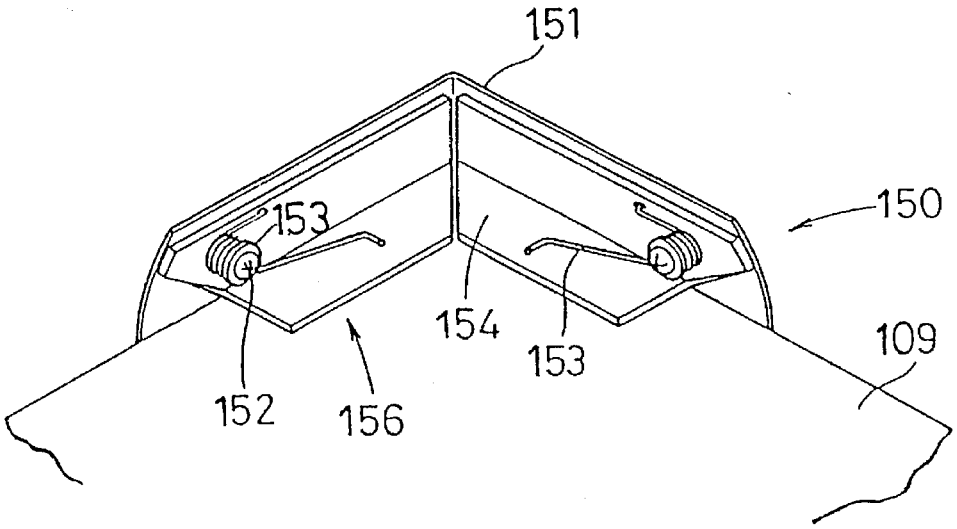

FIGS. 19 show another holder 150 which does not use the corner metal fittings 135 and 144. The holder 150 comprises a main body and two presser members 156, the main body being composed of an L-shaped side wall face 151 and an L-shaped bottom face 157 corresponding to the side wall face 151. Each presser member 156 is composed of a side face 155 and a bottom face 154. The side face 155 is rotatably attached to the side wall face 151 of the main body by means of a shaft 152. A torsion coil spring 153 is wound around each shaft 152 so as to force the bottom face 154 of the presser member 156 down.

When the holder 150 is in the state shown in FIG. 19(*a*) in which the presser members 156 are raised against the force of the torsion coil springs 153, a corner of the poster 109 is overlaid on the L-shaped bottom face 157 and then the presser members 156 are forced down with their bottom faces 154 being pressed against the corner of the poster 109 by the energizing force of the torsion coil springs 153, so that the poster 109 is held by the holder 150 as shown in FIG. 19(*b*).

Figure 20A:
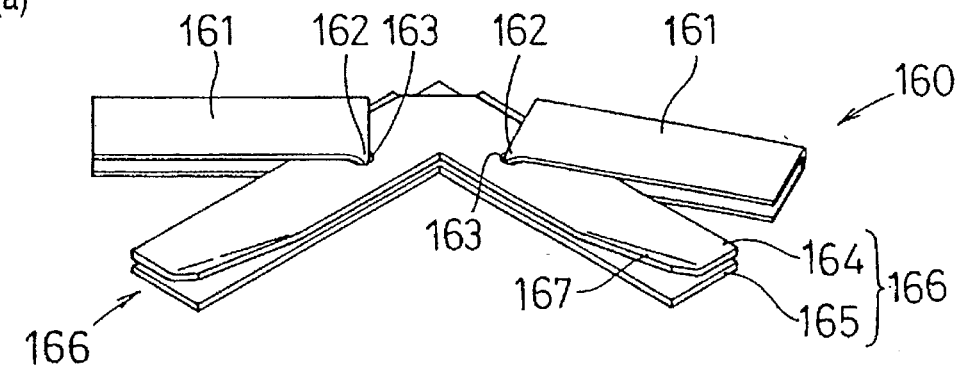
Figure 20B:
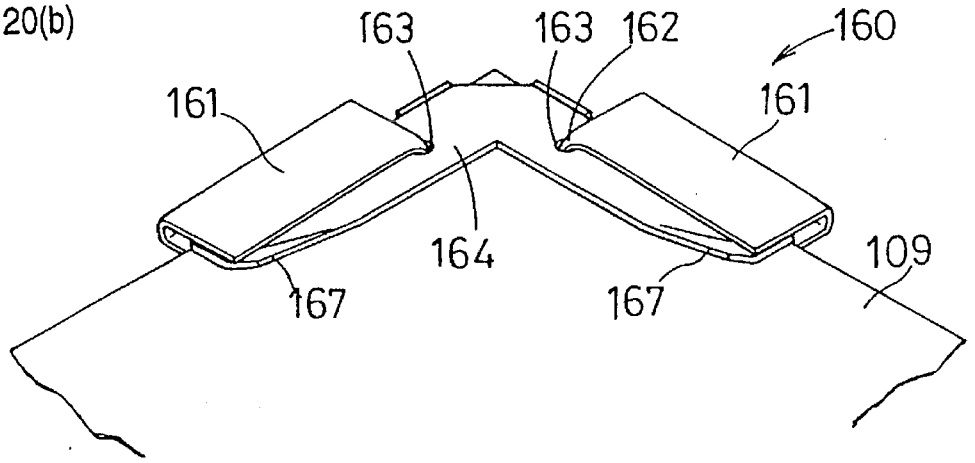
Figure 20C:
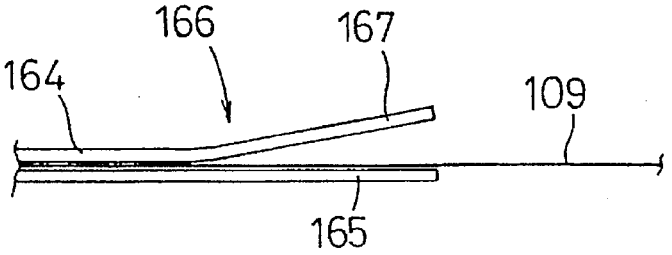

FIGS. 20 show another holder 160 which employs leaf springs. The holder 160 comprises an L-shaped main body 166 and two leaf springs 161 as shown in FIG. 20 (*a*). The main body 166 is composed of an upper L-shaped plate 164 and a lower L-shaped plate 165. These plates overlap with each other with a specified gap therebetween. Each leaf spring 161 takes the form of a rectangular board folded in two and has a corner end 162 inwardly bent. The corner ends 162 are respectively fitted in holes 163 defined in the upper L-shaped plate 164 of the main body 166 so that the leaf springs 161 can be respectively turned about the corner ends 162.

In the holder 160, a corner of the poster 109 is inserted between the upper L-shaped plate 164 and lower L-shaped plate 165 and then, the leaf springs 161 are so turned as to overlap with the main body 166 as shown in FIG. 20(*b*). The upper L-shaped plate 164 of the main body 166 has inclined areas 167 in each of which a corner end of the plate 164 is slightly bent as shown in the enlarged side view of FIG. 20(*c*). With this arrangement, when the leaf springs 161 are turned so as to overlap the main body 166, the leaf springs 161 press the inclined areas 167 towards the lower L-shaped plate 165, whereby the poster 109 is held between the upper L-shaped plate 164 and lower L-shaped plate 165.

Figure 21A:
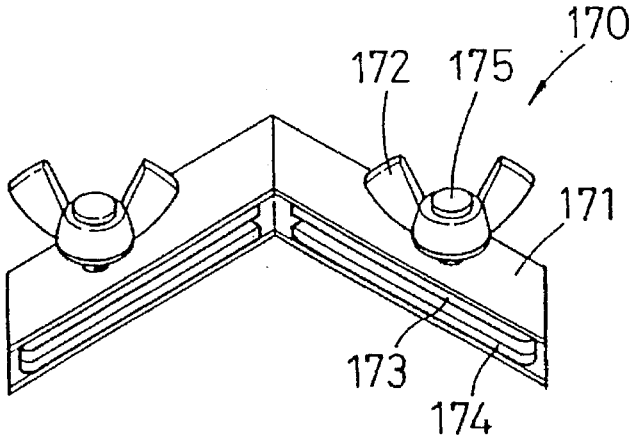
Figure 21B:
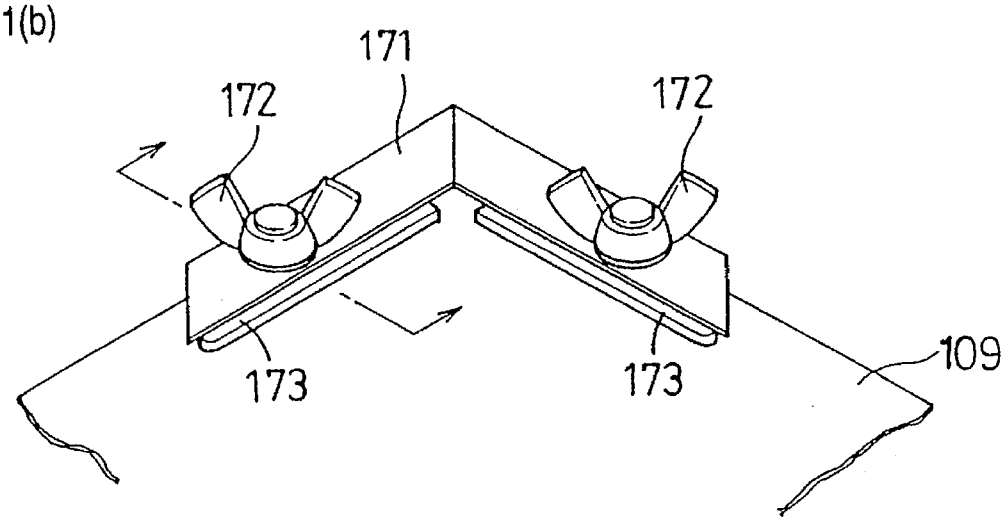
Figure 21C:
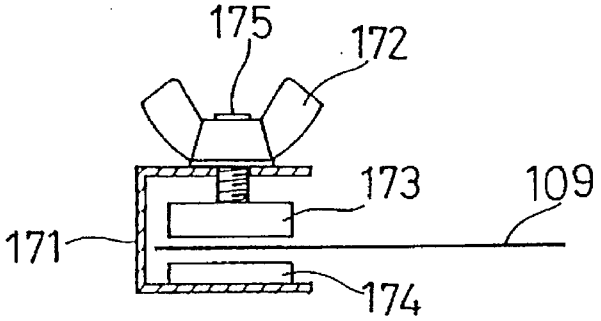

FIGS. 21 show another holder 170 which uses screws for holding a poster. As shown in FIGS. 21(*a*) and 21(*c*), the holder 170 has upper holding plates 173 and lower holding plates 174 within an L-shaped frame 171. A screw 175 is secured to each upper holding plate 173 and a fly nut 172 is screwed on the screw 175. By turning the fly nuts 172, each gap between the upper holding plate 173 and lower holding plate 174 is adjusted. The poster 109 is set in the holder 170 as shown in FIGS. 21(*b*) and 21(*c*) and held between the upper holding plates 173 and lower holding plates 174 by turning the fly nuts 172 in a fastening direction. Preferably, the inner faces (i.e., the faces at which the poster 109 is held) of the upper holding plates 173 and lower holding plates 174 are respectively provided with an elastic layer.

Figure 22:
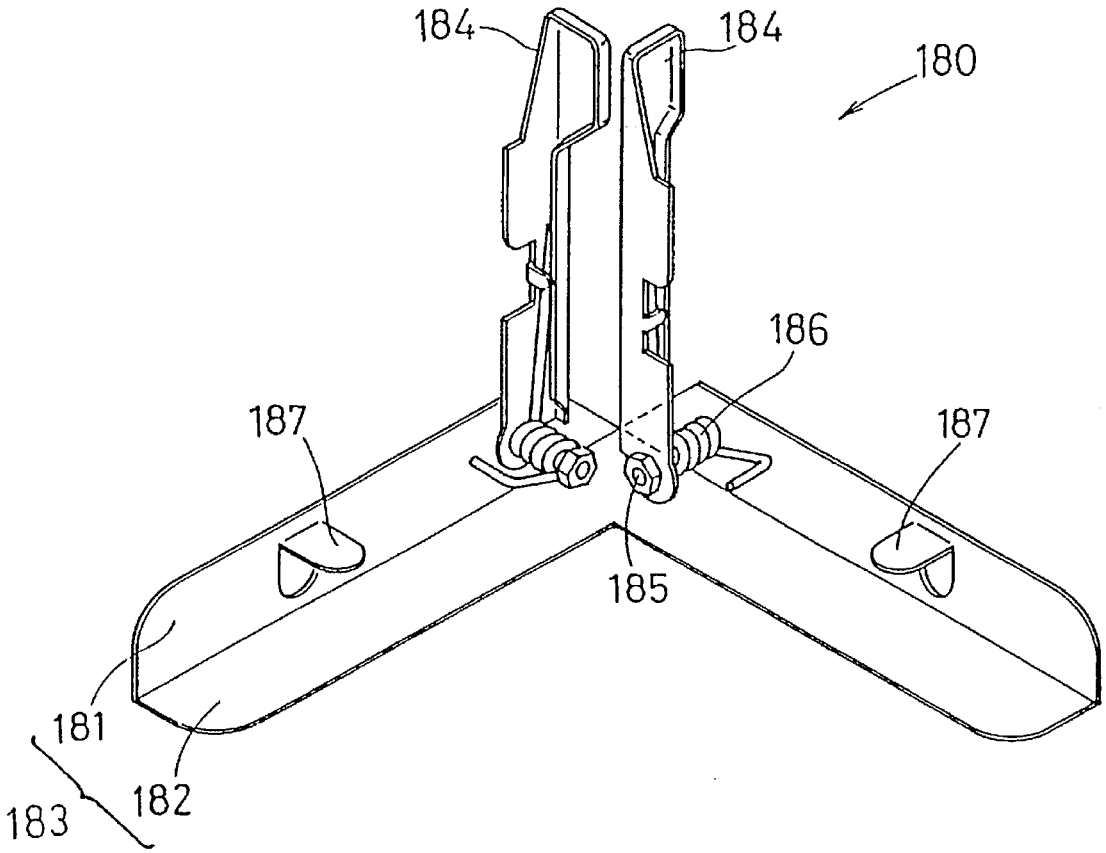

FIG. 22 shows still another holder 180 which utilizes z-clips. The holder 180 comprises a substantially L-shaped main body 183 composed of a side wall face 181 and bottom face 182, and two arms 184. As shown in FIG. 22, the arms 184 are rotatably attached to the side wall face 181 by means of shafts 185 respectively and each shaft 185 is provided with a torsion coil spring 186.

Figure 23A:
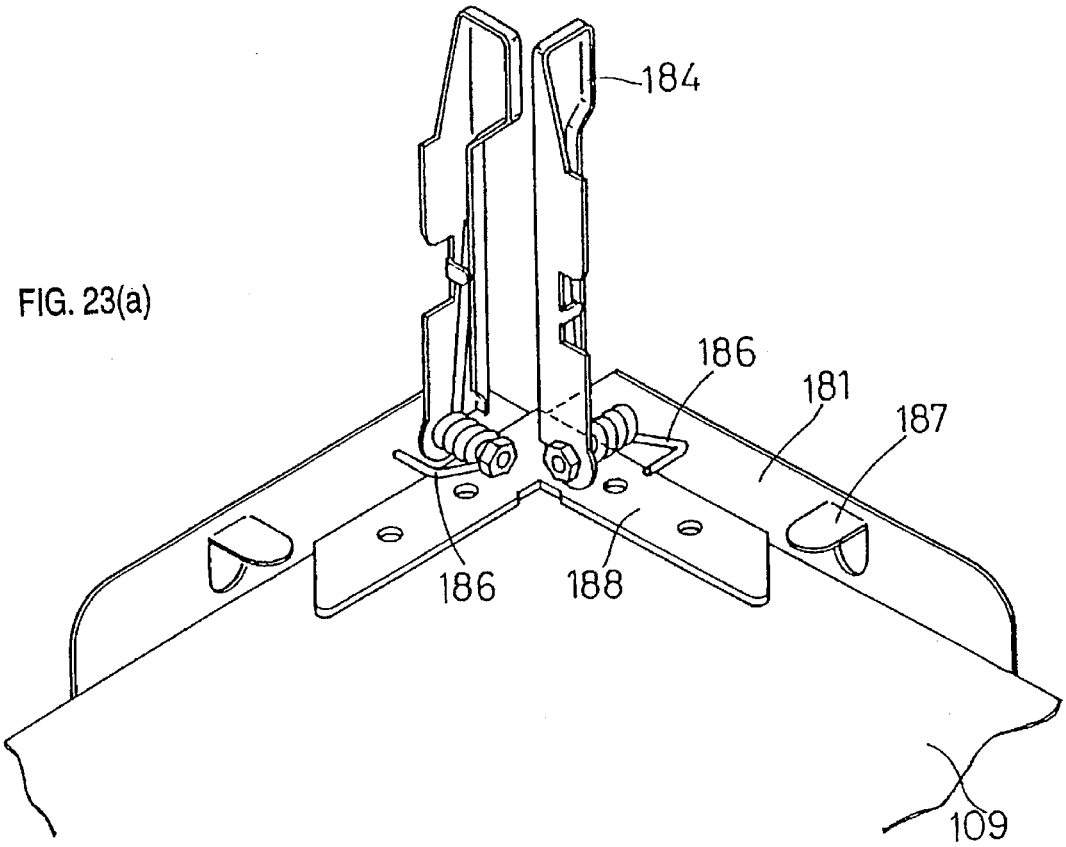
Figure 23B:
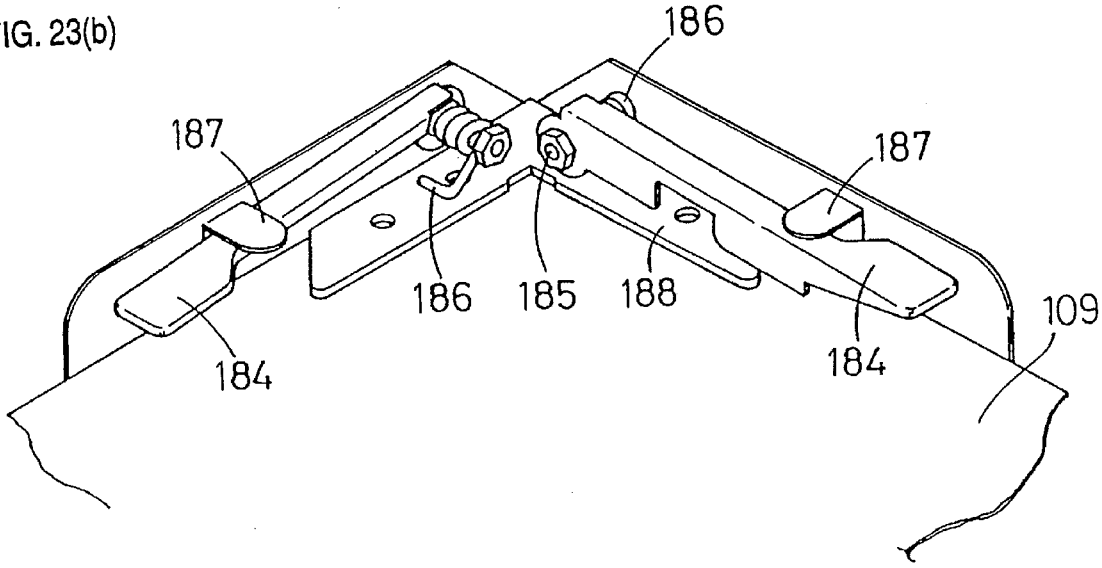

For holding the poster 109 by the holder 180, the poster 109 is placed on the bottom face 182 of the holder 180 and a corner metal fitting 188 is overlaid thereon, when the arms 184 are in their raised state shown in FIG. 23(*a*). Then, the arms 184 are forced down against the force of the torsion coil springs 186 and forcibly pressed by fixing projections 187. With this arrangement, the corner metal fitting 188 is pressed against the bottom face 182 by the force of the torsion coil springs 186 so that the poster 109 is held between the bottom face 182 and the corner metal fitting 188.

Third Embodiment

Figure 24:
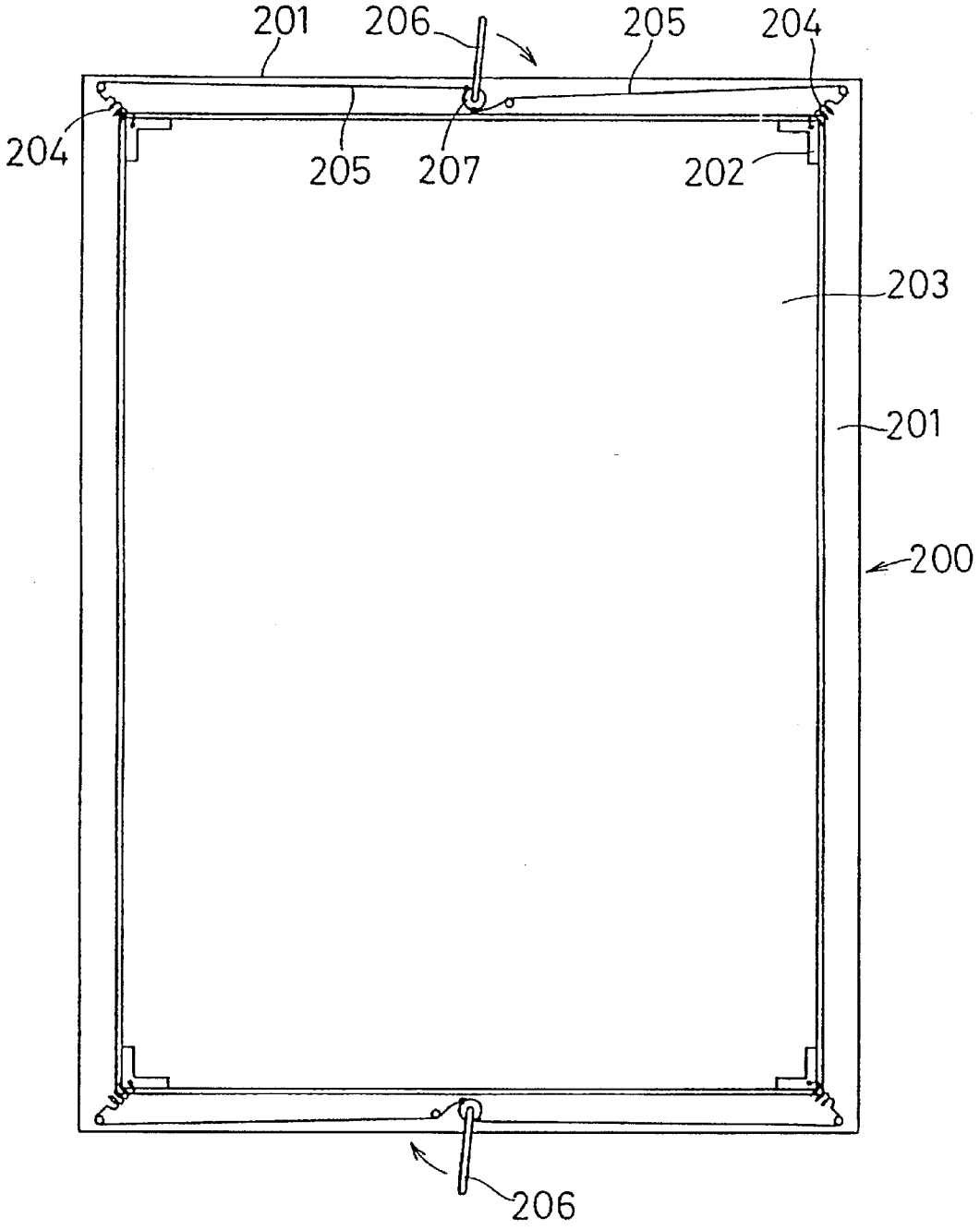

The stretching and fixing means of a tension panel according to a third embodiment of the invention will be hereinafter described. FIG. 24 shows a tension panel 200 in which springs (resilient members) 204 are stretched and fixed by the stretching and fixing means different from the L-shaped bars 103 shown in FIG. 8. In the embodiment shown in FIG. 24, four corner metal fittings 202 having the same structure as that of the fitting shown in FIG. 10 are affixed to the four corners of a poster 203. There are provided extension coil springs 204 each of which is attached to the corner metal fitting 202 at one end and connected at the other end to one end of a steel wire 205 for pulling the spring 204. The other end of each steel wire 205 is connected to a wheel 207 around which the steel wire 205 is to be wound. There are provided two wheels 207 at the center of the upper end and at the center of the lower end of the frame 201. The steel wires 205 connected to the right and left springs 204 are to be wound around each wheel 207.

Figure 25A:
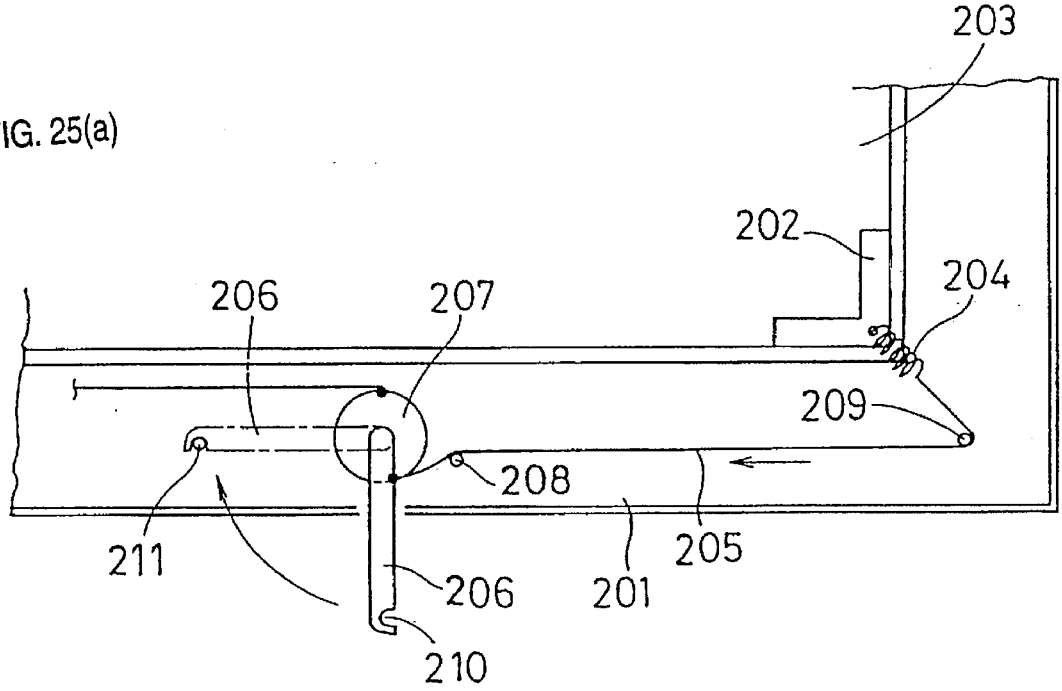
Figure 25B:
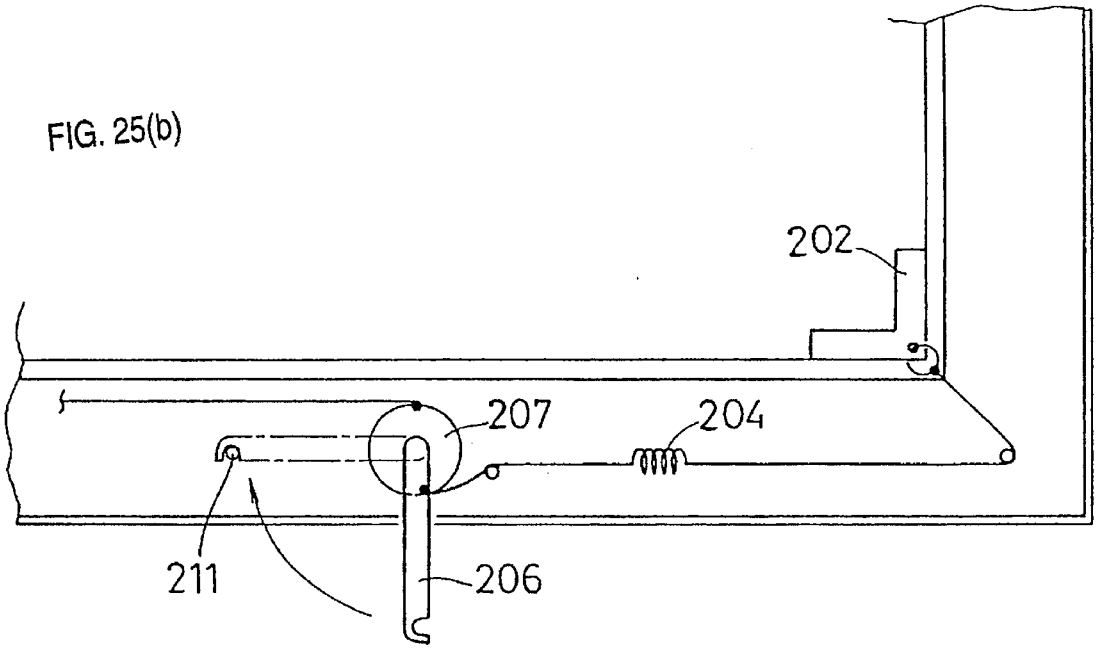

An enlarged view of the lower end of the tension panel 200 is shown in FIG. 25(*a*). As shown in this figure, the steel wire 205, one end of which is connected to the spring 204, extends to the wheel 207, passing around projecting bars 208 and 209. The wheel 207 is provided with a lever 206 having a hook 210 at the leading end thereof and with this lever 206, the wheel 207 rotates. Rotation of the lever 206 in the direction of the arrow the allows the wheel 207 to rotate in the same direction, thereby winding the steel wire 205 around the wheel 207. This causes the spring 204 to be stretched. When the spring 204 is stretched, the hook 210 of the lever 206 is hooked on a pin 211 projecting from a frame 201. The position of the pin 211 is adjusted so that appropriate tensile force is exerted on the spring 204, and the poster 203 is properly stretched. The positions of the projecting bar 209 and pin 211 etc. are adjusted such that the spring 204 is stretched in the extending direction of a bisector which bisects the interior angle of a corner of the poster 203 by 45°. It is to be noted that the spring 204 is not necessarily directly connected to the corner metal fitting 202 but may be interposed in the steel wire 205 as shown in FIG. 25(*b*). In this case, the same mechanism can be applied for stretching the poster 203.

Figure 26A:
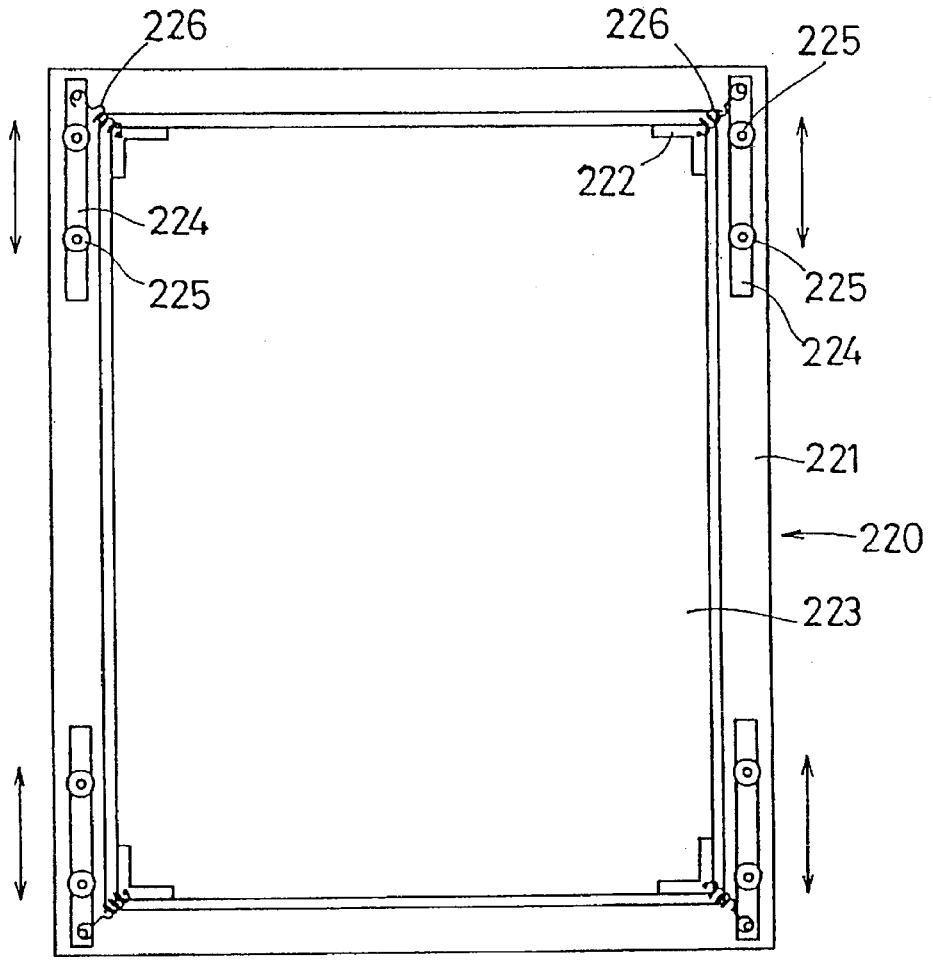
Figure 26B:
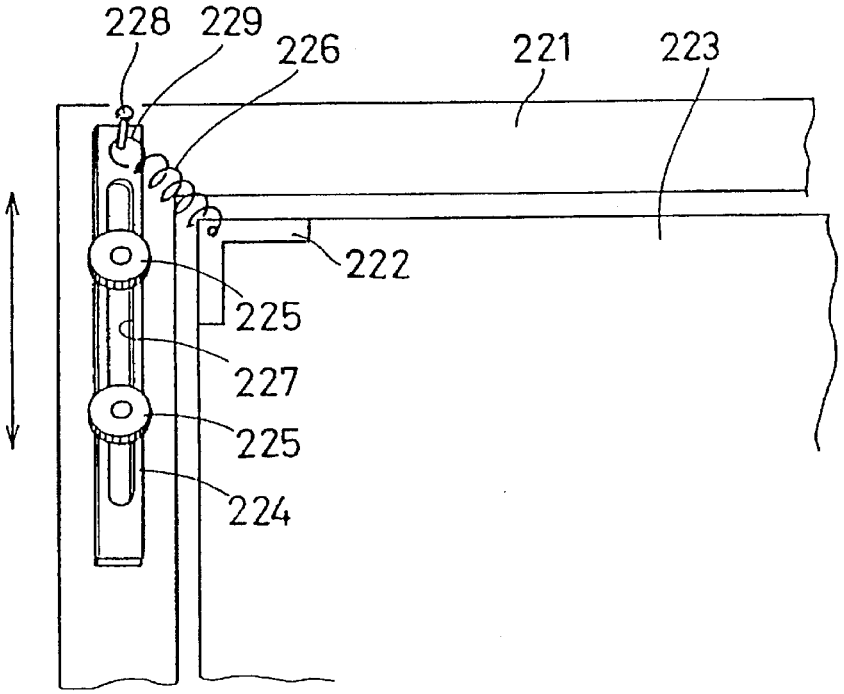

FIG. 26 shows a tension panel 220 according to a modification, in which another stretching and fixing means is employed in order to stretch and fix resilient members (springs). In this modification, four corner metal fittings 222 having the same structure as that of the fitting shown in FIG. 10 are affixed to the four corners of a poster 223 as shown in FIG. 26(*a*). Attached to each corner metal fitting 222 is one end of a spring 226, the other end of which is connected to a slide bar 224.

FIG. 26(*b*) shows, in enlarged form, the slide bar 224 and its surroundings. As shown in this figure, one end of the spring 226 is connected to the corner metal fitting 222 while the other end has a ring-shaped hook 229 which is hooked on a pin 228 disposed at one end of the slide bar 224. The slide bar 224 has a cut groove 227 at the center thereof and screws 225 are inserted in the cut groove 227. The slide bar 224 is secured to a frame 221 by these screws 225. By sliding the slide bar 224 along the cut groove 227, with the screws 225 loosened, the tensile force and pulling direction of the spring 226 which stretches the corner metal fitting 222 are adjusted. In this example, the slide bar 224 slides in such a way that the spring 226 is stretched in the extending direction of a bisector which bisects the interior angle of a corner of the poster 223 by 45°.

Forth Embodiment

Figure 27:
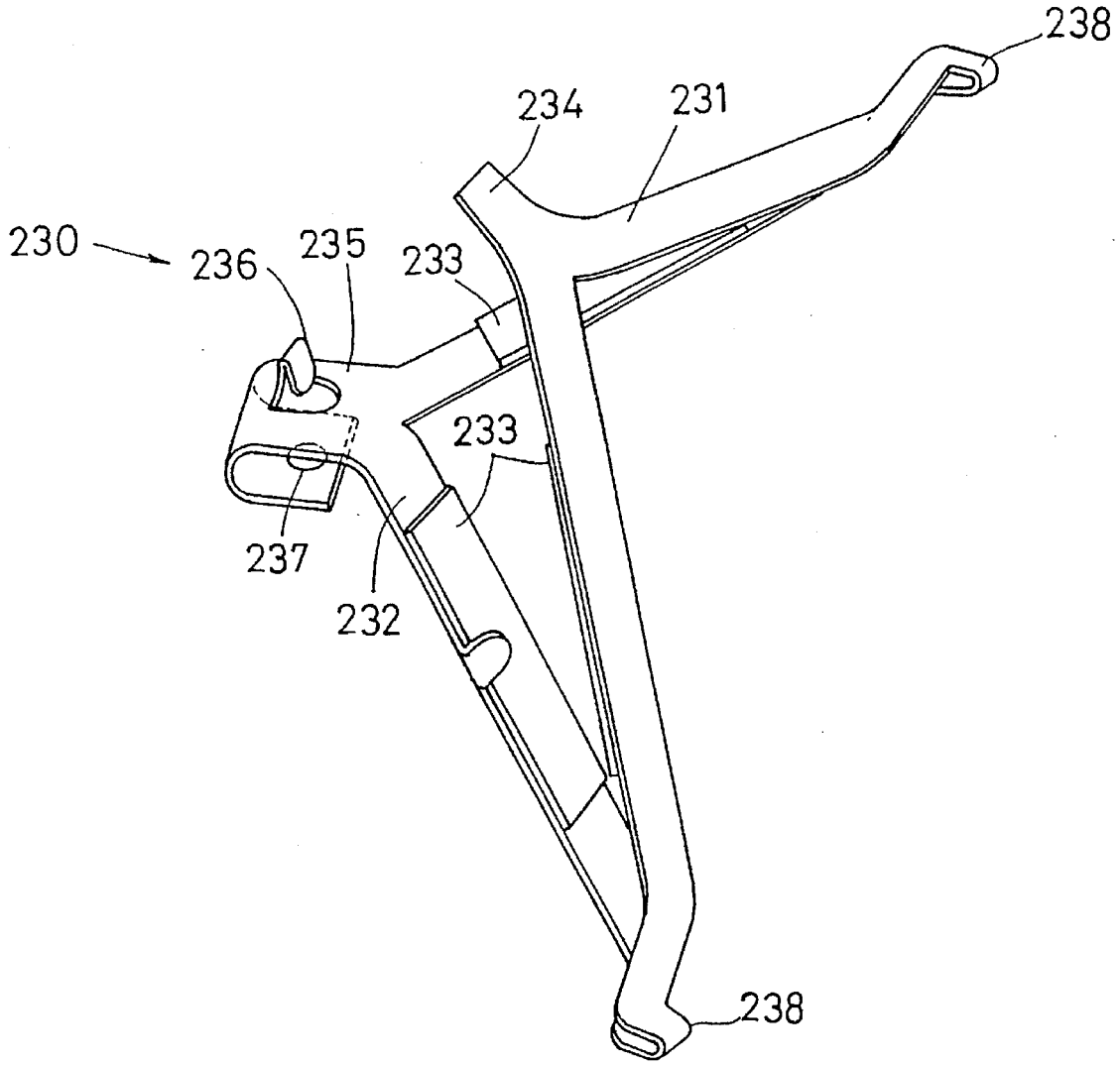

FIG. 27 shows an L-shaped retaining member 230 for holding a corner of a poster, according to a forth embodiment of the invention. The L-shaped retaining member 230 is composed of a substantially L-shaped upper plate 231 and a substantially L-shaped lower plate 232, these plates facing to each other. Resin sheets 233 are affixed to the opposed faces of these plates 231 and 232 at their respective centers and these resin sheets 233 posses elasticity. As shown in FIG. 27, a projection 234 extends from the bent part of the L-shaped upper plate 231, while a projection 235 extends from the bent part of the L-shaped lower plate 232. The projection part 235 has a hook 236 which rises therefrom and an eye 237 defined at a downwardly folded end.

The L-shaped retaining member 230 is a leaf spring made from a metal and when no force is applied to the member 230 from outside, the upper plate 231 and lower plate 232 are not fitted to each other but opened as shown in FIG. 27. Therefore, the upper plate 231 and lower plate 232 need to be pressed by a force stronger than the spring force in order to fit these plates to each other. While the upper plate 231 and lower plate 232 are integrally formed, and are connected to each other at their foot ends 238 in this embodiment, the L-shaped retaining member 230 may be composed of separate members whose foot ends are fixed or fitted to each other using eyelets or by inserting with each other. In addition, the L-shaped retaining member 230 may be integrally formed from a resin.

Figure 28:
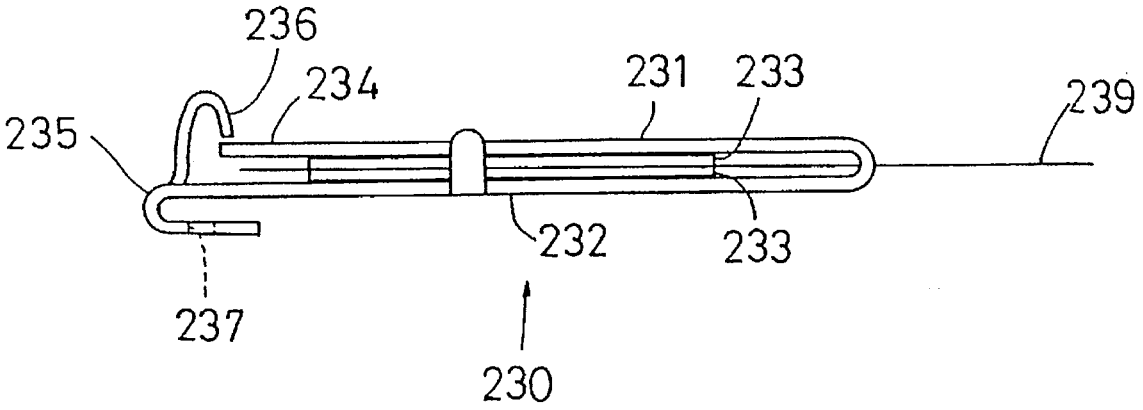

FIG. 28 shows the side view of the L-shaped retaining member 230 as it holds a corner of a poster 239. As shown in FIG. 28, the upper plate 231 is forced down with its projection 234 caught by the hook 236 so that the upper plate 231 and lower plate 232 are fitted to each other and the poster 239 is sandwiched and held between the resin sheets 233 affixed to the upper and lower plates 231, 232. Due to the elasticity of these resin sheets 233, the poster 239 is fixedly held without slippage.

Figure 29:
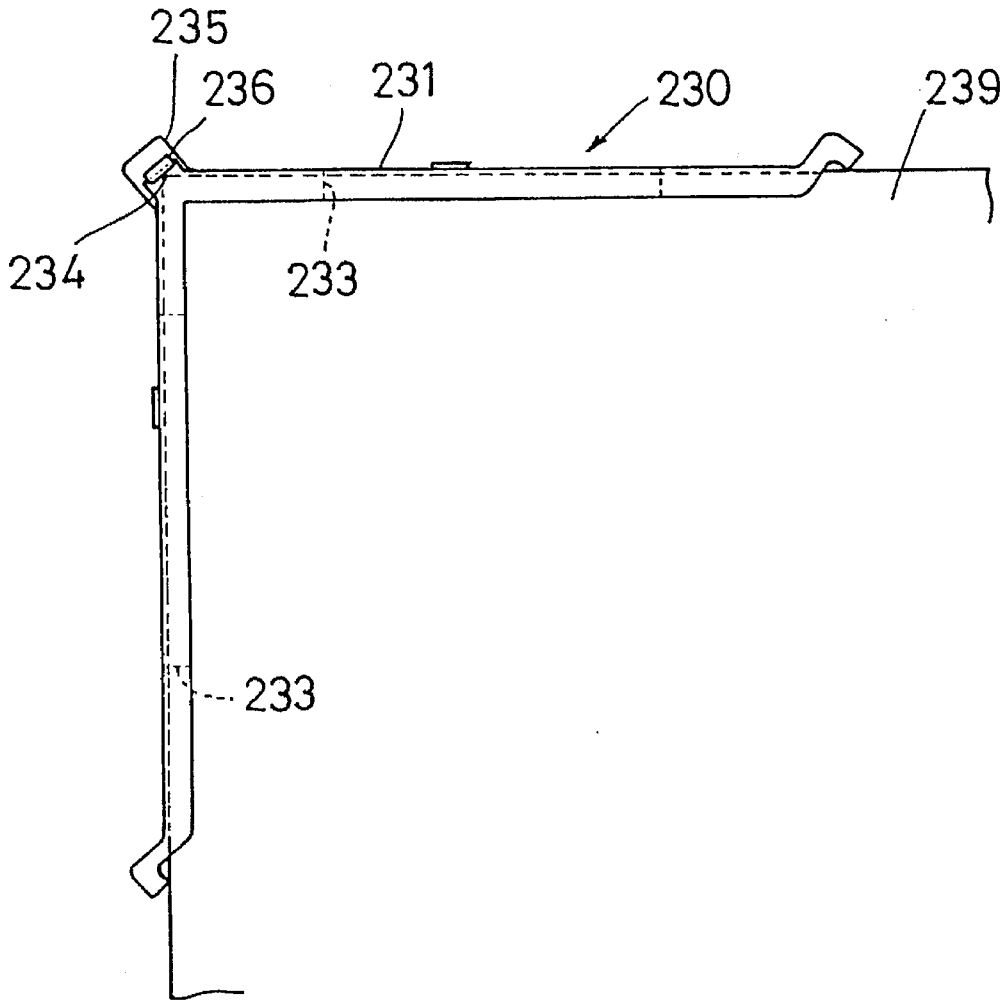

FIG. 29 shows a plan view of the retaining member 230 as it holds the poster 239. It is obvious from this figure that the poster 239 is held by the L-shaped retaining member 230 at the narrow area running along two sides of a corner of the poster 239. Although the vertex of the corner of the poster 239 is not sandwiched by the resin sheets 233 in this embodiment, the resin sheets 233 may be arranged so as to sandwich the vertex of the corner.

In this embodiment, the L-shaped retaining member 230 holds a corner of the poster 239 by sandwiching. But, it is also possible to hold a corner of the poster 239 by sticking.

Figure 30:
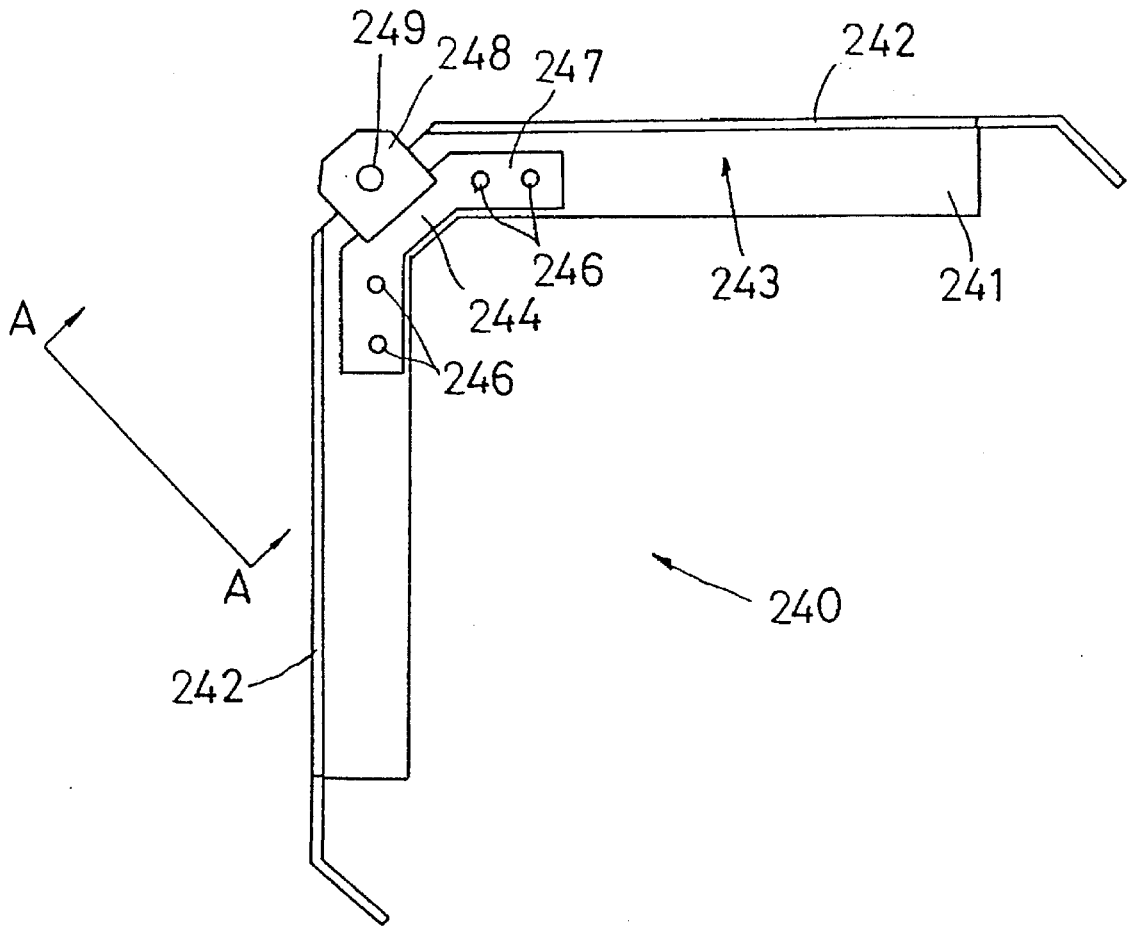

Now, an L-shaped resilient assembly for imparting tension to the poster 239 will be described. A plan view of an L-shaped resilient assembly 240 according to one embodiment is shown in FIG. 30. The L-shaped resilient assembly 240 comprises an L-shaped main body 243 and leaf spring body 244 attached to the main body 243. The L-shaped main body 243 is comprised of an L-shaped bottom plate 241 and two side walls 242 which stand upright along the outer side faces of the L-shaped bottom plate 241. The leading ends (i.e., the foot ends of "L") of the side walls 242 are inwardly bent at 45° as shown in FIG. 30.

Figure 31:
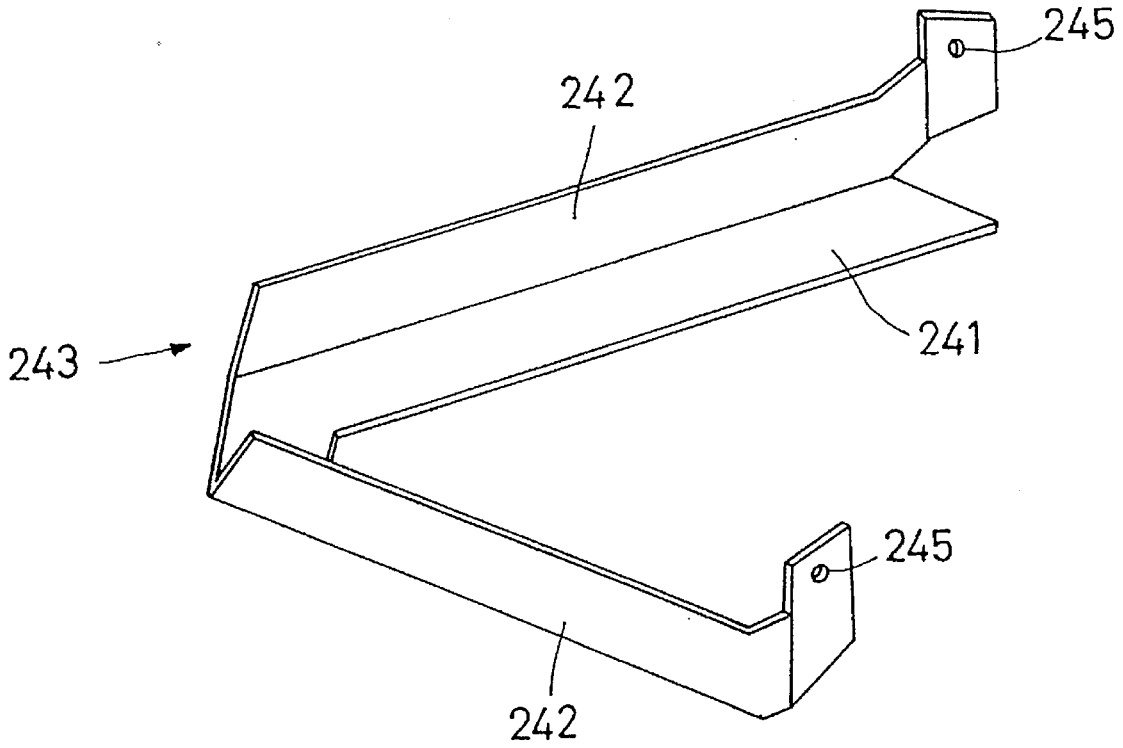

FIG. 31 is a perspective view showing only the L-shaped main body 243. It is understood from this figure that the respective bent ends of the side walls 242 are also upwardly bent above the L-shaped bottom plate 241 and have holes 245.

Figure 32A:
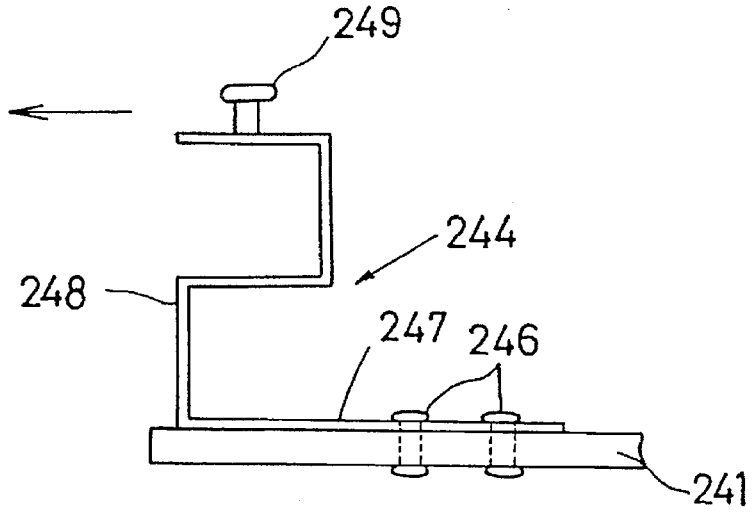
Figure 32B:
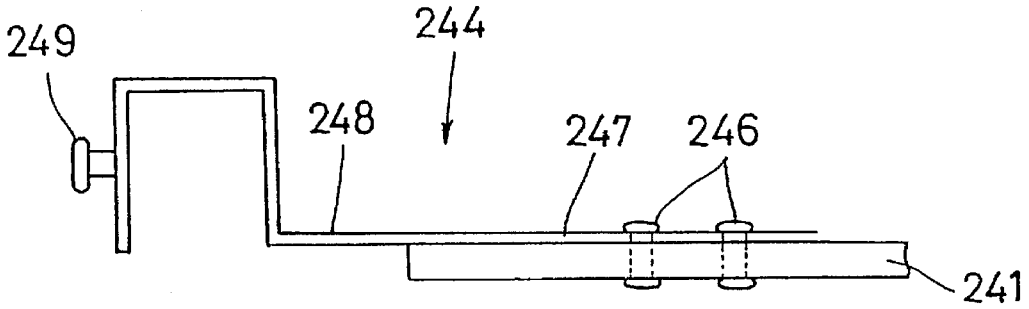

The leaf spring body 244 is secured to the bent part of the L-shaped bottom plate 241 with rivets 246, as shown in FIG. 30. FIG. 32(*a*) is a side view taken along line A—A of FIG. 30. As shown in this figure, the leaf spring body 244 is made up of a flat portion 247 and hook-shaped portion 248. At the top of the hook-shaped portion 248, there is provided a hook 249. The condition of the hook-shaped portion 248 shown in FIG. 32(*a*) corresponds to that of FIG. 30, but the hook-shaped portion 248 is, in fact, in a stretched state as shown in FIG. 32(*b*) when no force is applied to the portion 248. The leaf spring body 244 is entirely formed from a leaf spring material, and therefore it is necessary to apply a force greater than the spring force to the hook-shaped portion 248 in order to bend the hook-shaped portion 248 as shown in FIG. 32(*a*). When the poster 239 is in a displayed state as described later, tension is exerted on the hook 249 and the hook-shaped portion 248 is in the bent state shown in FIG. 32(*a*).

Figure 33:
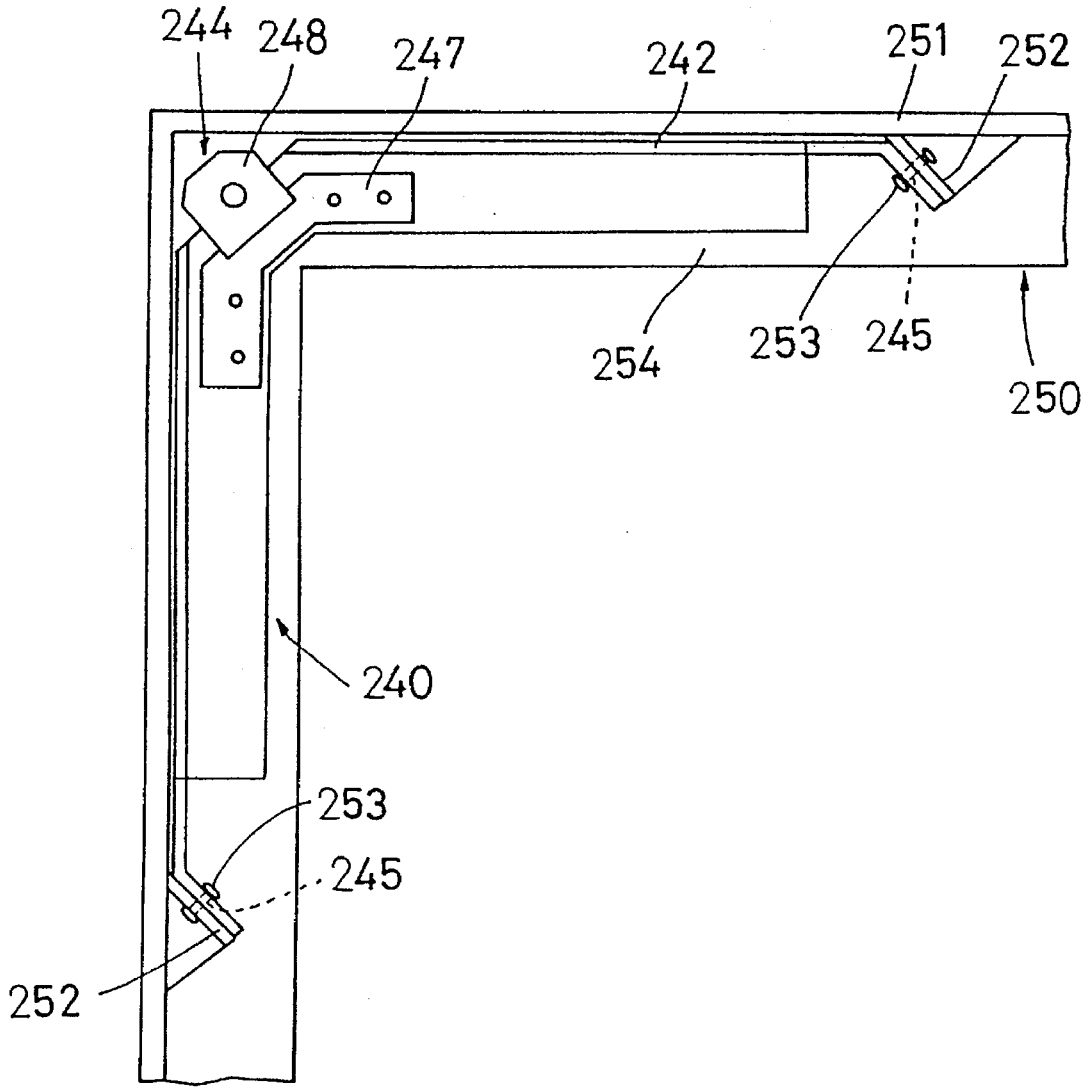

FIG. 33 shows the L-shaped resilient assembly 240 of FIG. 30, as it is attached to a frame 250 for posters. As shown in this figure, the frame 250 has fasteners 252 at its side walls 251, and machine screws 253 which pass through the holes 245 are inserted in the respective fasteners 252, whereby the side walls 242 are pivotally attached.

This arrangement allows the L-shaped resilient assembly 240 to pivot about an axis which connects the holes 245 defined at both ends of the assembly 240, so that the L-shaped resilient assembly 240 changes from a lying state in which the assembly 240 lies along a bottom face 254 of the frame 250 as shown in FIG. 33 to a raised state.

Figure 34:
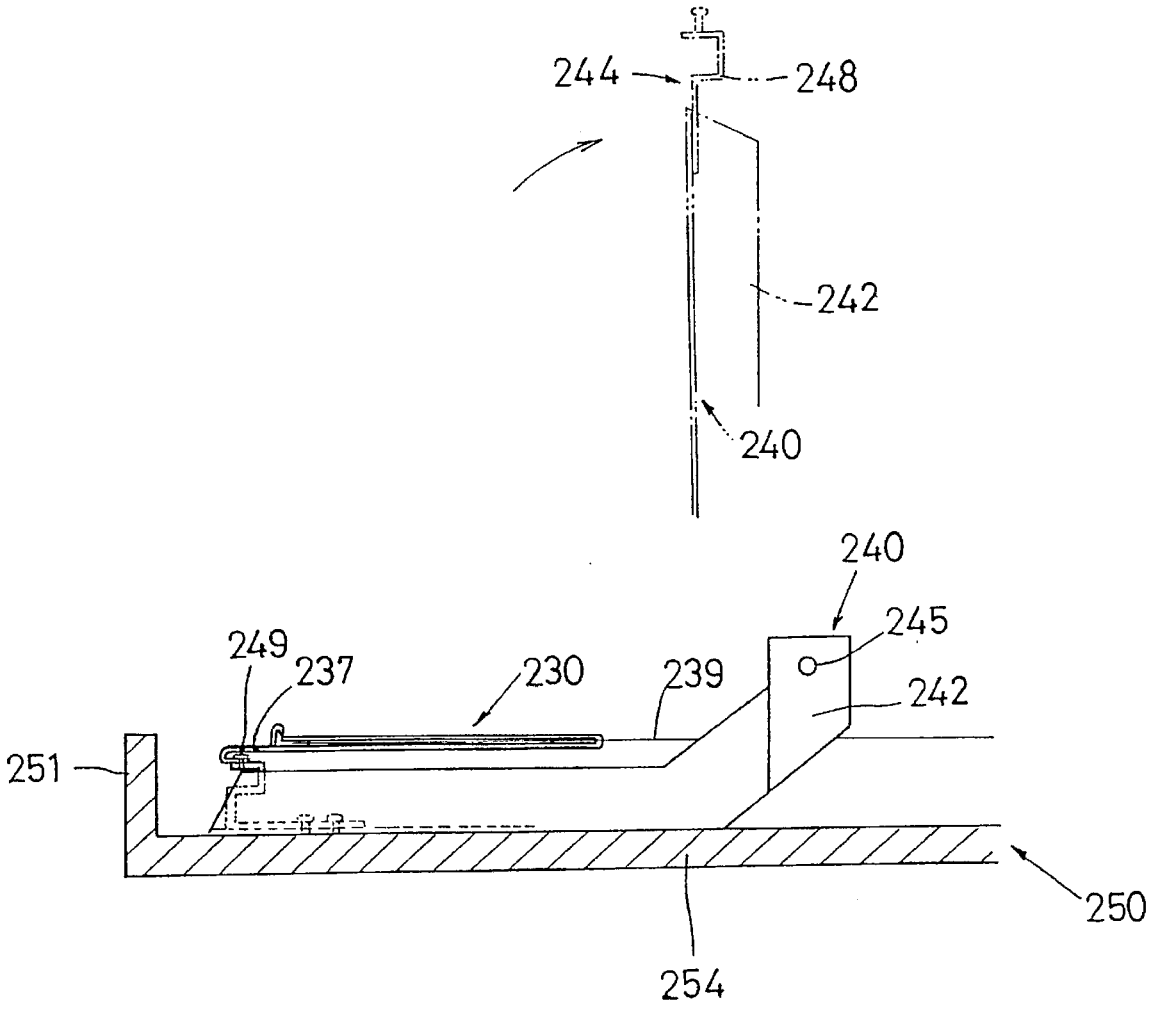

FIG. 34 is a side view in which the poster 239 is set in the frame 250, and held by the L-shaped retaining member 230 in the state shown in FIG. 30 (i.e., lying state). In order to set the poster 239 as shown in FIG. 34, the L-shaped resilient assembly 240 is first brought into the raised state indicated by two-dot chain line in FIG. 34. In the raised state, the hook-shaped portion 248 of the leaf spring body 244 is stretched as shown in FIG. 32(*b*). The hook 249 of the hook-shaped portion 248 thus stretched is hooked into the eye 237 (see FIG. 28) of the L-shaped retaining member 230 which holds a corner of the poster 239. In this state, no tension is exerted on the poster 239. Then, the L-shaped resilient assembly 240 pivots about the axis connecting the holes 245 as described earlier, changing to the lying state indicated by solid line in FIG. 34, and the hook-shaped portion 248 of the leaf spring body 244 is pulled by the poster 239 so that it is bent as shown in FIG. 32(*a*). Thus, the force for restoring the hook-shaped portion 248 to the initial stretched state is exerted on the poster 239 as tension. The L-shaped retaining member 230 is designed to have two sides of the same length which are so connected as to make an interior angle of 90° as shown in FIG. 29, and the hook-shaped portion 248 of the leaf spring body 244 is bent and stretched in the extending direction of a bisector which bisects the interior angle of a corner of the frame 250, so that tension is exerted on the poster 239 in the extending direction of a bisector which bisects the interior angle of a corner of the poster 239, when the poster 239 is set in the frame 250. Although the exerting direction of tension is not limited to the direction of a bisector of a corner of the poster 239, such a direction is preferable in order to prevent the creation of creases etc. on the poster 239.

Figure 35:
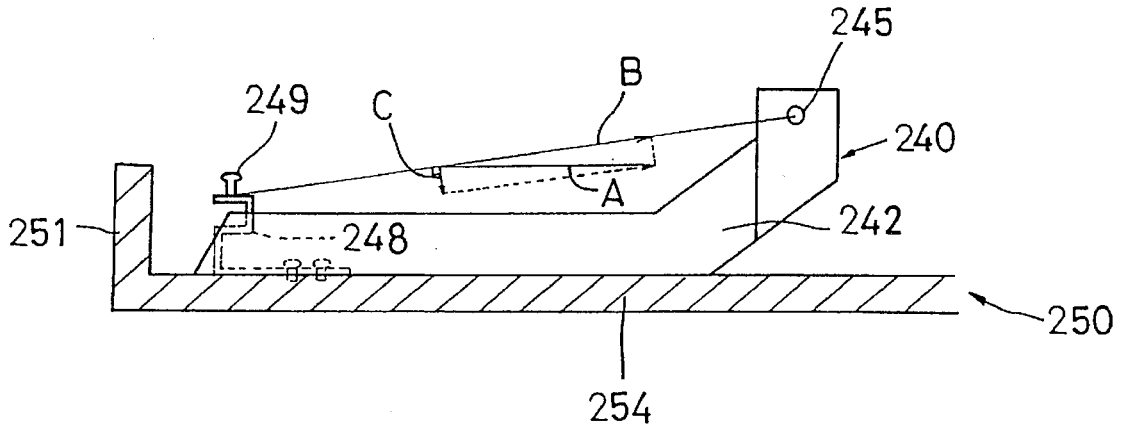

The lying state depicted by solid lines in FIGS. 33 and 34 is a stable condition for the following reason. In this state, a force is exerted from the poster 239 subjected to tension onto the hook 249 in a direction parallel to the bottom face 254 of the frame 250, as indicated by arrow A in FIG. 35. The hook 249 turns about the axis connecting the holes 245, so that the parallel force indicated by arrow A can be divided into a component force B which is directed in the direction of an axis connecting the hook 249 and holes 245 and a component force C which is directed in a direction perpendicular to the above line. The component force C presses the L-shaped resilient assembly 240 against the frame 250. Therefore, even if little vibration is transmitted to the poster 239 set in the frame 250, the poster 239 will not come off the frame 250. The poster 239 can be removed from the frame 250 only when it is pulled by a user with a force greater than the component force C.

There exists a state between the lying state and raised state, in which the force A and force B are exerted in the same direction and therefore the force C is not produced. This state is unstable because the component force B reaches a maximum and the L-shaped resilient assembly 240 can pivot about the axis connecting the holes 245 in any directions.

Fifth Embodiment

Figure 36A:
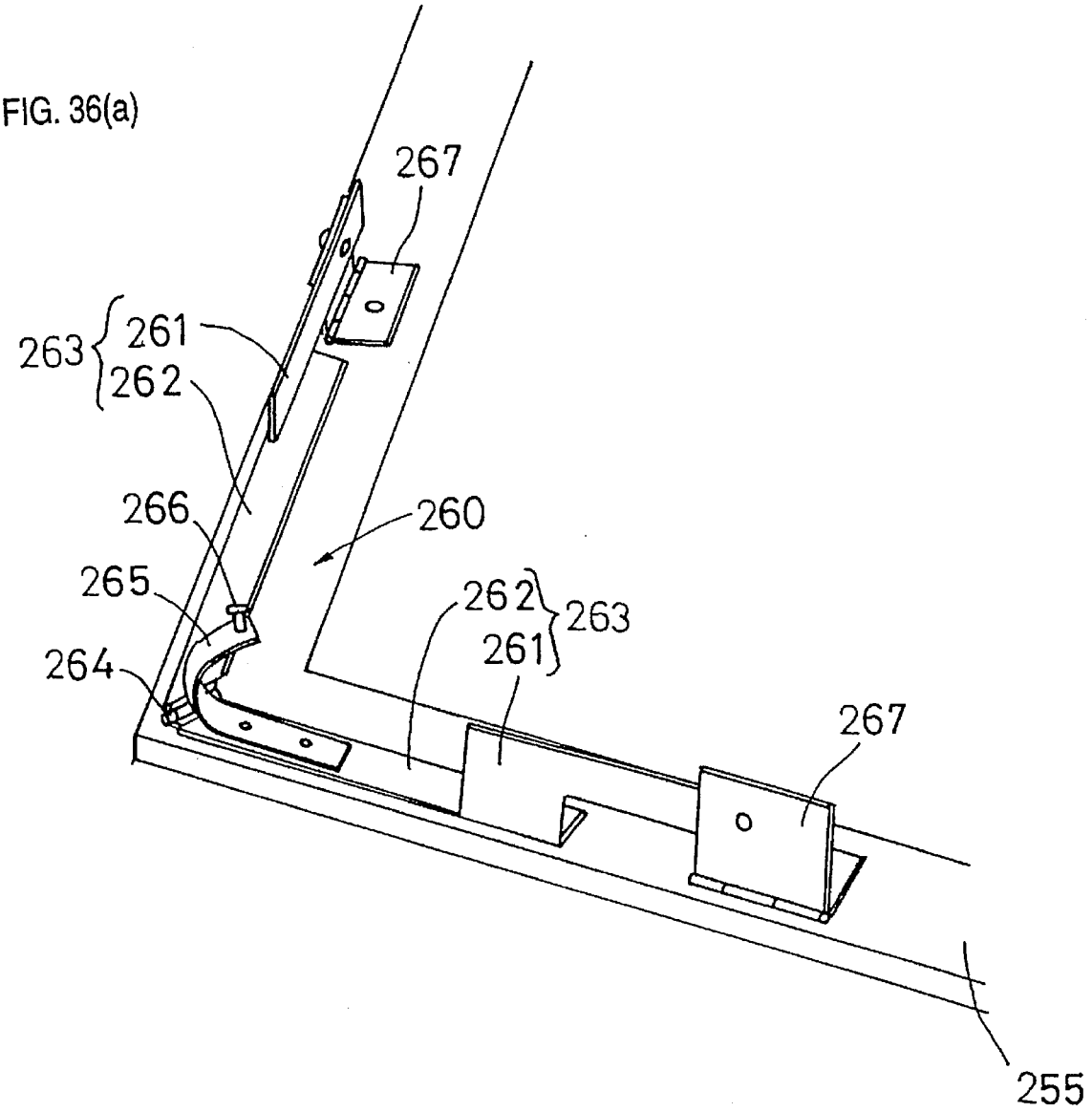
Figure 36B:
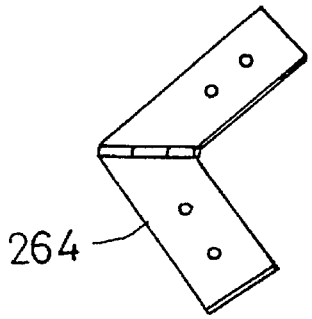

FIG. 36(*a*) shows an L-shaped resilient assembly 260 according to a fifth embodiment of the invention, as it is attached to a frame 255. As shown in this figure, the L-shaped resilient assembly 260 is comprised of two arms 263 of the same length which are connected by a hinge 264 shown in FIG. 36(*b*) so as to make an interior angle of 90°. Each arm 263 is bent such that a side plate 261 is perpendicularly abut a bottom plate 262. As shown in FIG. 36(*a*), the side plate 261 of either of the arms 263 is provided with a leaf spring 265 including a hook 266 which stands upright at an end of the spring 265. The hook 266 is hooked into the eye 237 (see FIG. 28) of the L-shaped retaining member 230, whereby the leaf spring 265 imparts tension onto the poster like the leaf spring body 244 of the forth embodiment. The side plates 261 of the arms 263 are respectively attached to the frame 255 by hinges 267 at their ends. A coil spring may be used in the place of the leaf spring 265. In the case of a coil spring, the coil spring may be supported by both of the bottom plates 262.

Figure 37:
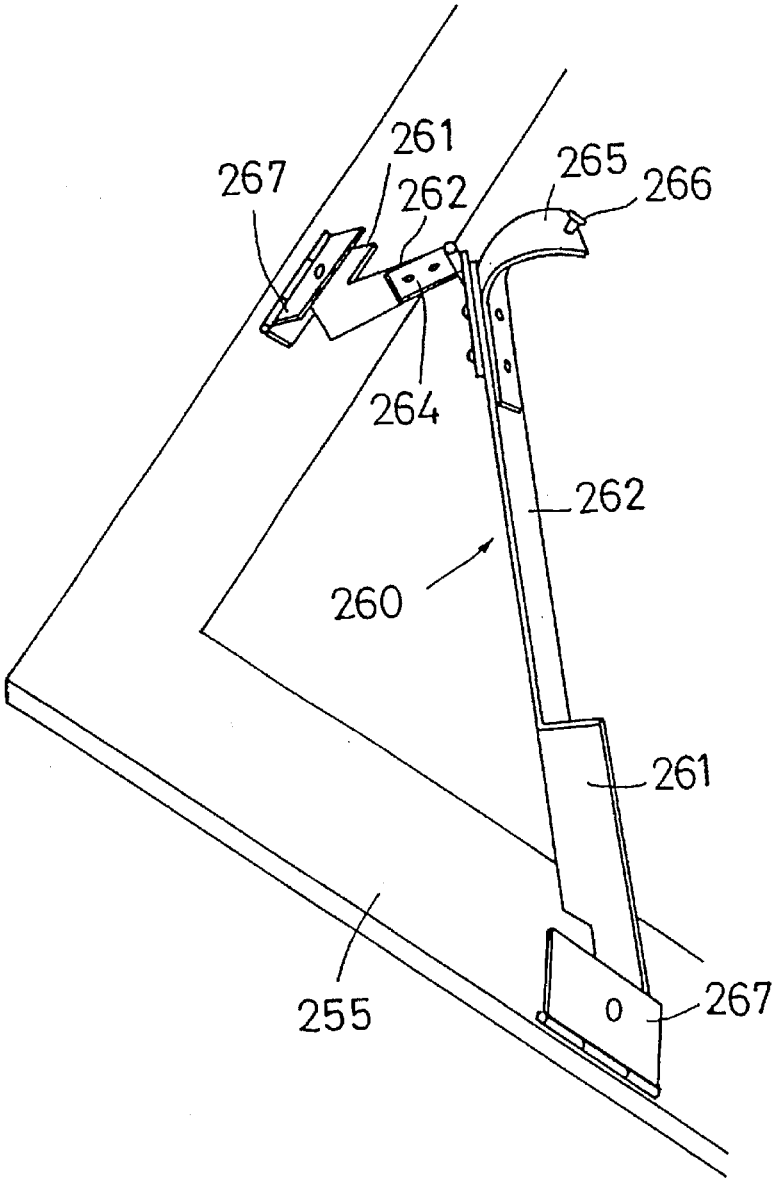
Figure 38:
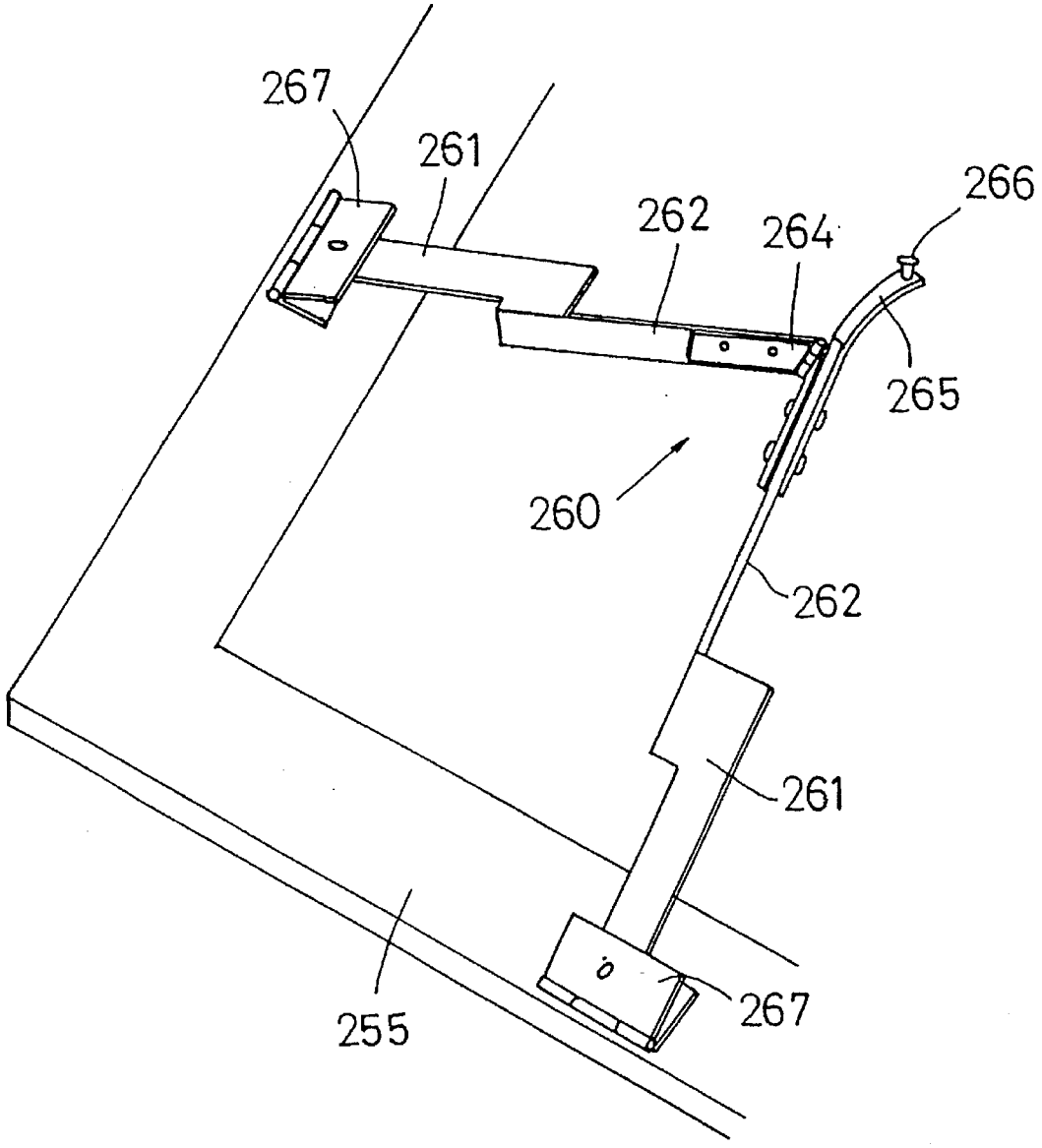

With such a structure of the L-shaped resilient assembly 260 and the way of connecting the assembly 260 to the frame 255, the L-shaped resilient assembly 260 can be rotated about an axis connecting the hinges 267, changing from its lying state to its raised state, just as the third embodiment. FIG. 36 shows the lying state and the L-shaped resilient assembly 260 changes from the lying state to the raised state shown in FIG. 38 after passing through the state shown in FIG. 37. When changing to the raised state, the hinge 264 connecting the bottom plates 262 is bent. For setting the poster in the frame 255, the hook 266 is hooked in the eye 237 of the L-shaped retaining member 230 like the forth embodiment when the L-shaped resilient assembly 260 is in the raised state shown in FIG. 38. Then, the L-shaped resilient assembly 260 is brought back into the lying state shown in FIG. 6 through the state shown in FIG. 37. When the poster is set with the member 260 in the lying state, tension is exerted on the poster by the spring force of the leaf spring 265 in the extending direction of a bisector which bisects the interior angle of a corner of the poster.

In this embodiment, the frame 255 does not include a projection like the fasteners 252 shown in FIG. 33 but the side plates 261 are attached to the frame 255 by means of the hinges 267 in such a way that the side plates 261 are positioned in the neighborhood of the outer periphery of the frame 255 when the resilient assembly 260 is in the lying state. This allows the poster to be set close to the outer periphery of the frame 255. Therefore, the frame 255 of the fifth embodiment may have a narrower width than that of the frame 250 of the forth embodiment. Note that the frame 255 may have side walls similar to the side walls 251 provided in the frame 250 of the forth embodiment.

Sixth Embodiment

Figure 39:
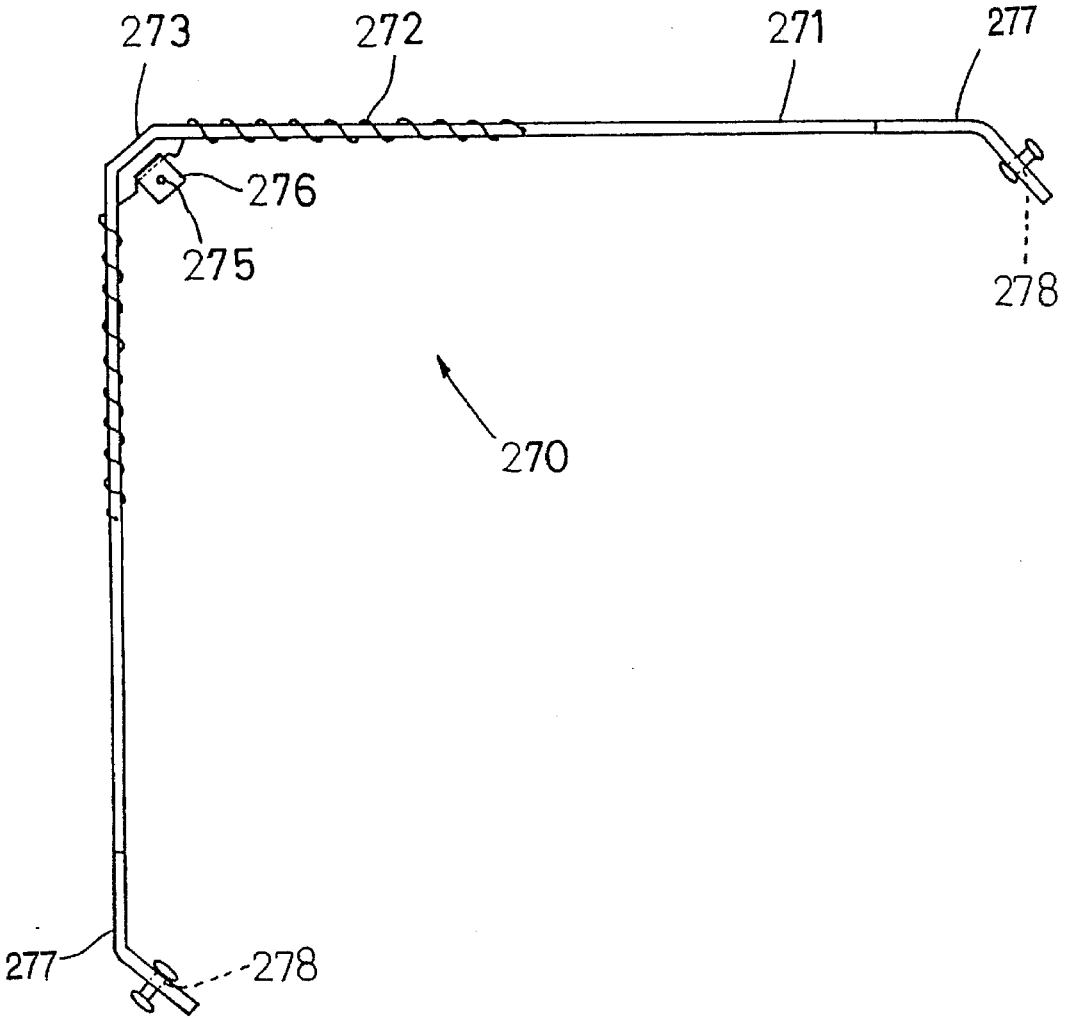
Figure 40:
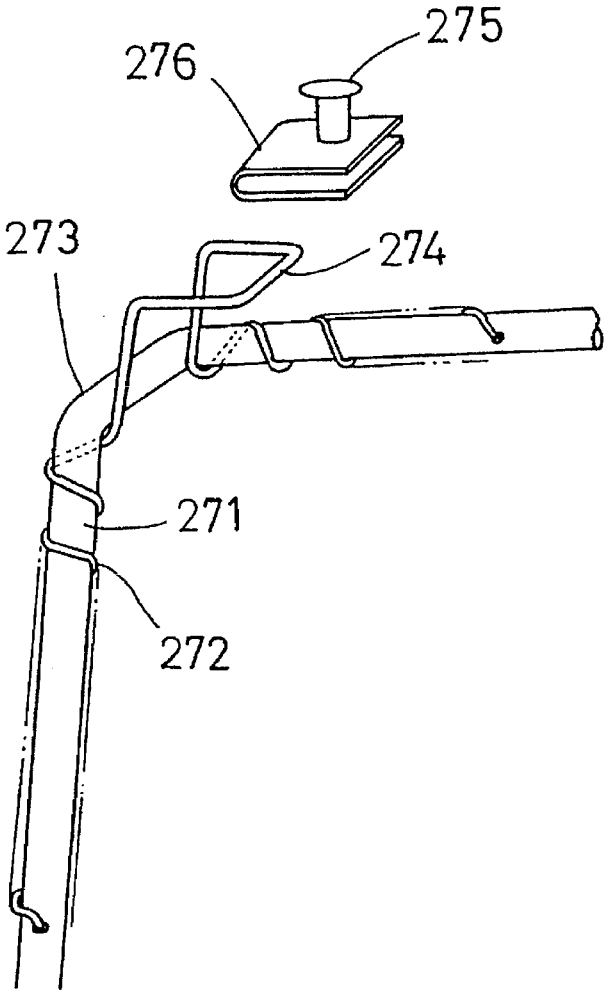

FIG. 39 shows an L-shaped resilient assembly 270 according to a sixth embodiment of the invention. The L-shaped resilient assembly 270 has an L-shaped bar 271 bent at right angles. As shown in FIG. 39, a spring 272 is wound around the L-shaped bar 271 except its corner part 273. The corner part 273 and its surroundings are shown in enlarged form in FIG. 40. In the corner part 273, the spring 272 is not wound around the L-shaped bar 271 but bent to form a straight line part 274. A bent metal plate 276 having a hook 275 standing up thereon is hooked over the straight line part 274. FIG. 39 shows a condition in which the bent metal plate 276 is hooked over the straight line part 274.

Figure 41:
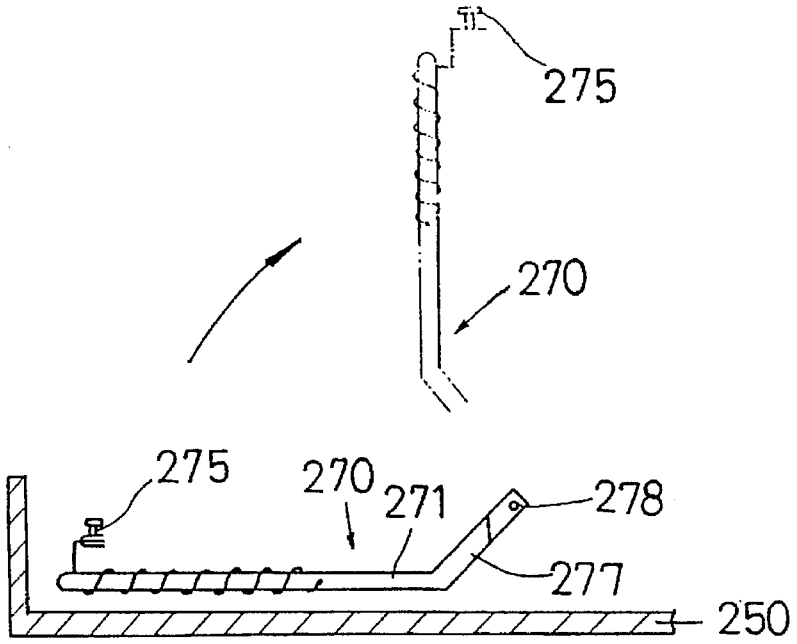

Both ends 277 of the L-shaped bar 271 are bent upwards as shown in FIG. 41 and the middle of the bent parts are inwardly bent at 45° as shown in FIG. 39. The portions bent at 45° are respectively provided with holes 278. A machine screw is inserted into each hole 278 thereby attaching the L-shaped resilient assembly 270 to the frame in the same manner as that of the forth embodiment shown in FIG. 33 and permitting the member 270 to pivot from the lying position to the raised position about an axis which connects the holes 278, like the forth embodiment. The hook 275 of the L-shaped resilient assembly 270 is hooked in the eye 237 of the L-shaped retaining member 230, thereby setting the poster in the frame. The force of the spring 272 is exerted as tension on a corner of the poster in the extending direction of a bisector which bisects the interior angle of the corner.

Figure 42:
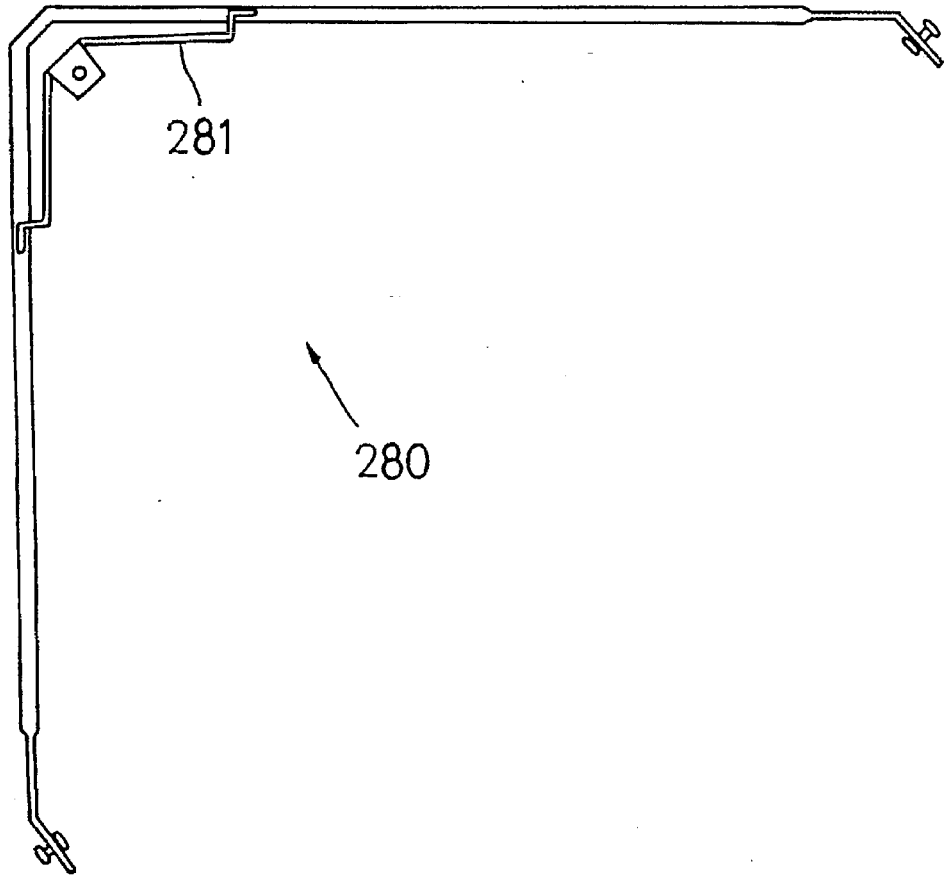
Figure 43A:
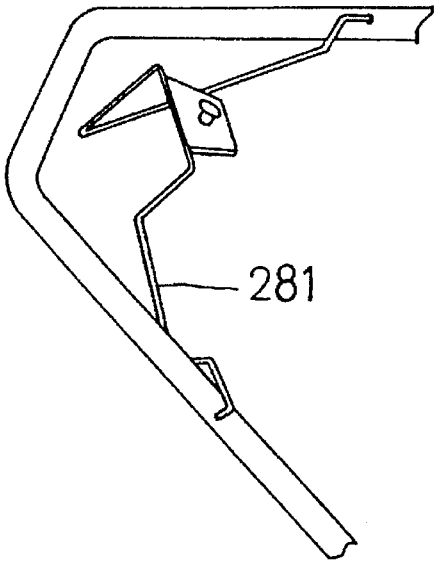
Figure 43B:
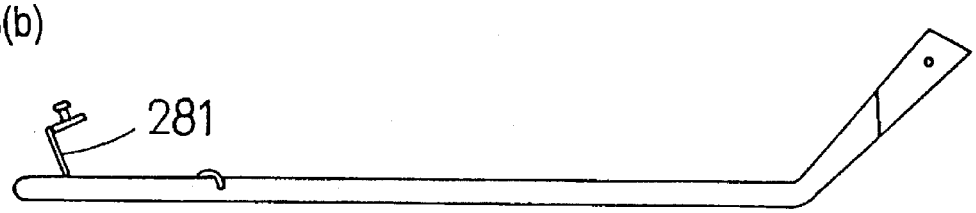

FIG. 42 is a plan view of an L-shaped resilient assembly 280 that is a modification of the L-shaped resilient assembly 270. FIG. 43(*a*) is an enlarged view of the corner part of the L-shaped resilient assembly 280, while FIG. 43(*b*) is its side view. In this modification, the force of a wire spring 281 is exerted as tension on a corner of the poster in the extending direction of a bisector which bisects the interior angle of the corner.

Figure 44:
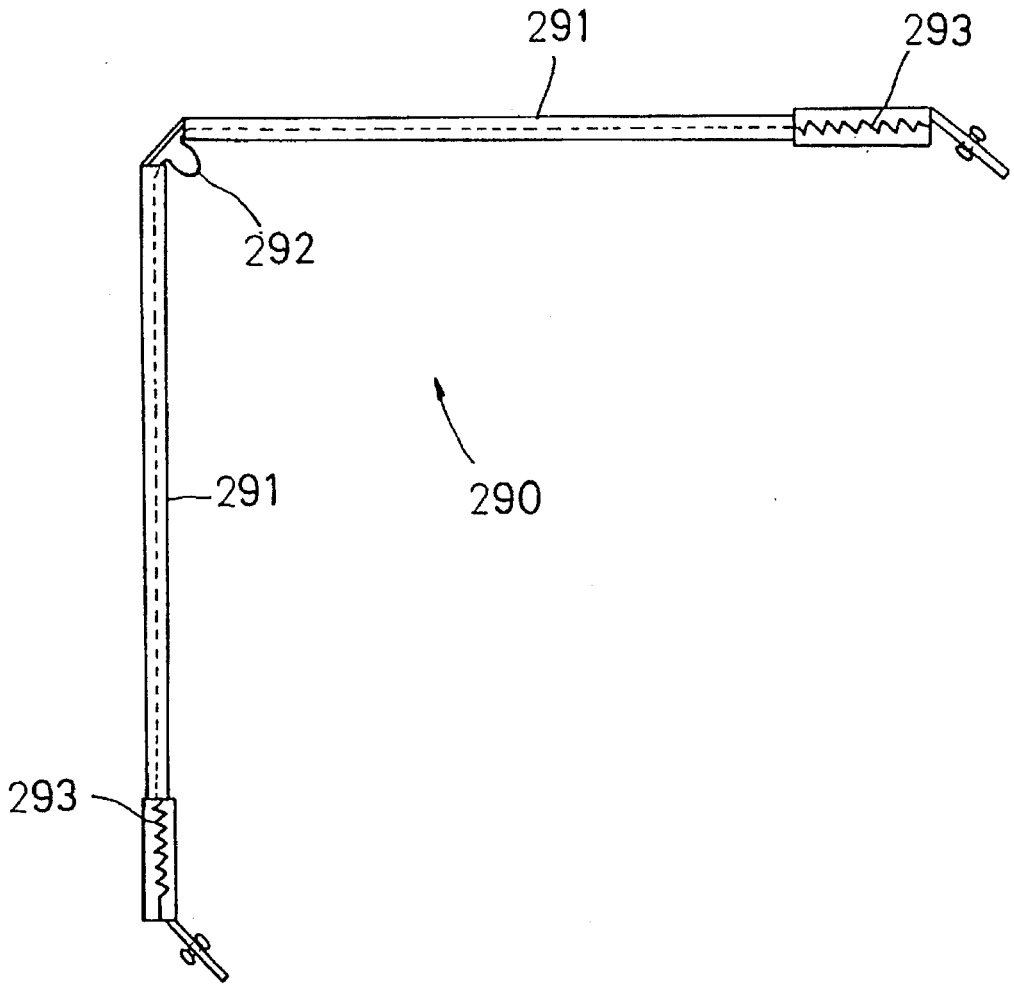
Figure 45:
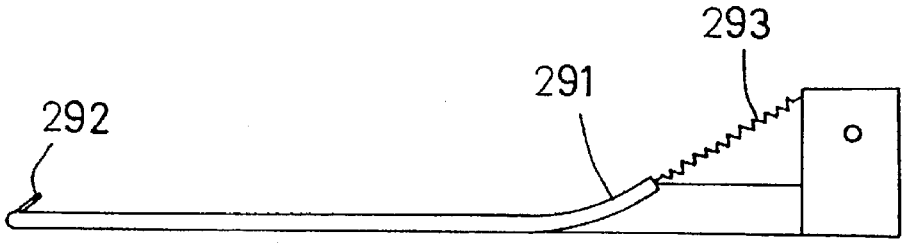

FIG. 44 is a plan view of an L-shaped resilient assembly 290 that is another modification of the L-shaped resilient assembly 270 and FIG. 45 is its side view. In this modification, the L-shaped resilient assembly 290 comprises arms 291 formed from hollow pipes through which a wire 292 passes. The wire 292 is exposed at the corner of the resilient assembly 290 and connected to extension coil springs 293 at the ends thereof. The L-shaped retaining member 230 is hooked over the exposed portion of the wire 292. In this example, the elastic forces of the extension coil springs 293 transmitted to the wire 292 are exerted as tension on a corner of the poster in the extending direction of a bisector which bisects the interior angle of the corner.

Figure 46:
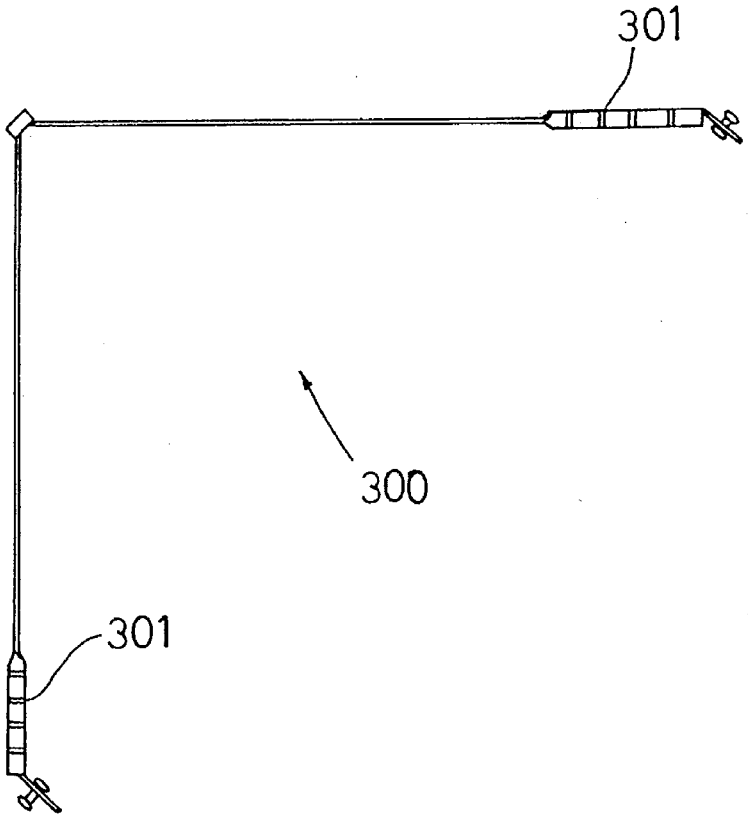
Figure 47:
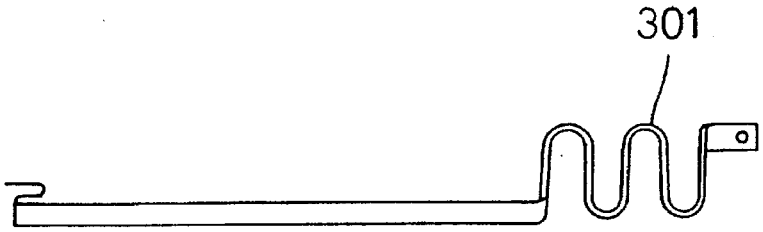

FIG. 46 is a plan view of an L-shaped resilient assembly 300 that is a further modification of the L-shaped resilient assembly 270 and FIG. 47 is its side view. In this modification, the forces of leaf springs 301 disposed at both ends of the L-shaped resilient assembly 300 are exerted as tension on a corner of the poster in the extending direction of a bisector which bisects the interior angle of the corner.

Figure 48:
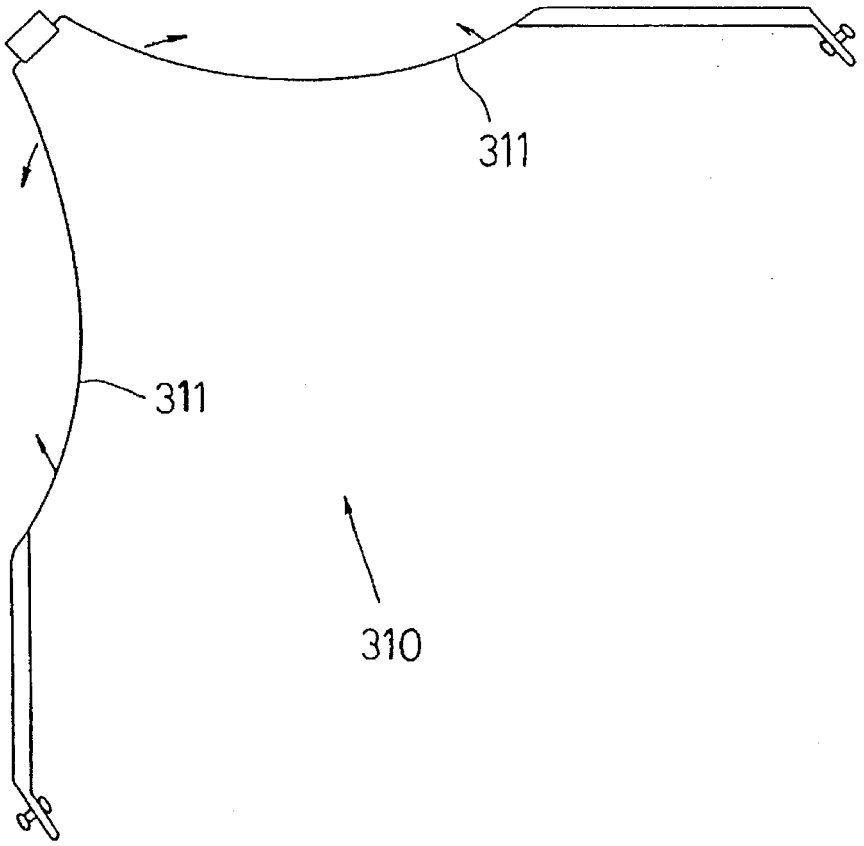
Figure 49:
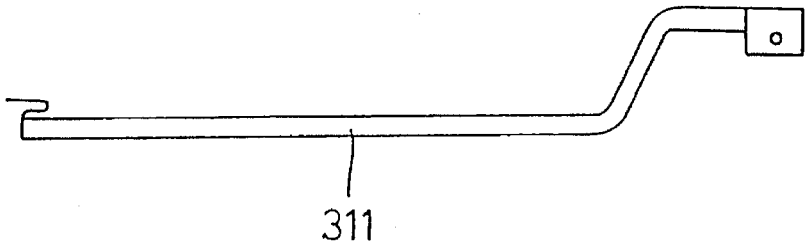
Figure 50:
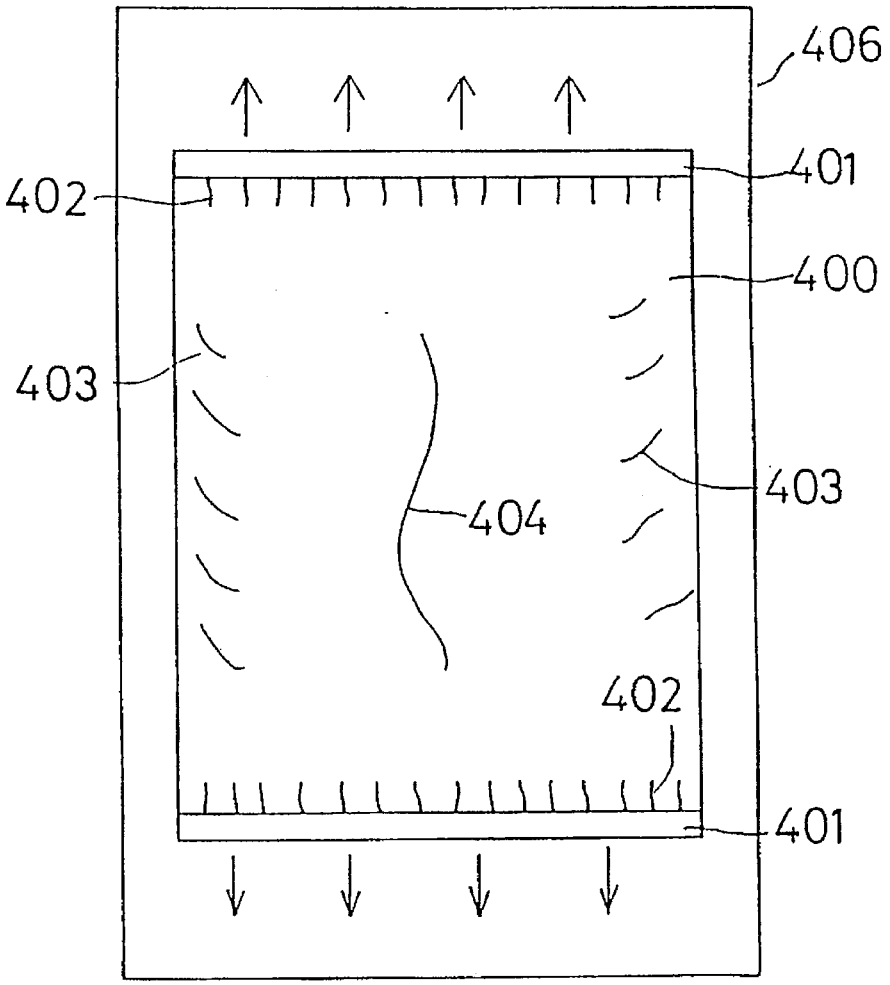
PRIOR ART FIG. 50
FIG. 50 is a plan view of a tension panel according to a prior art.
Figure 51:
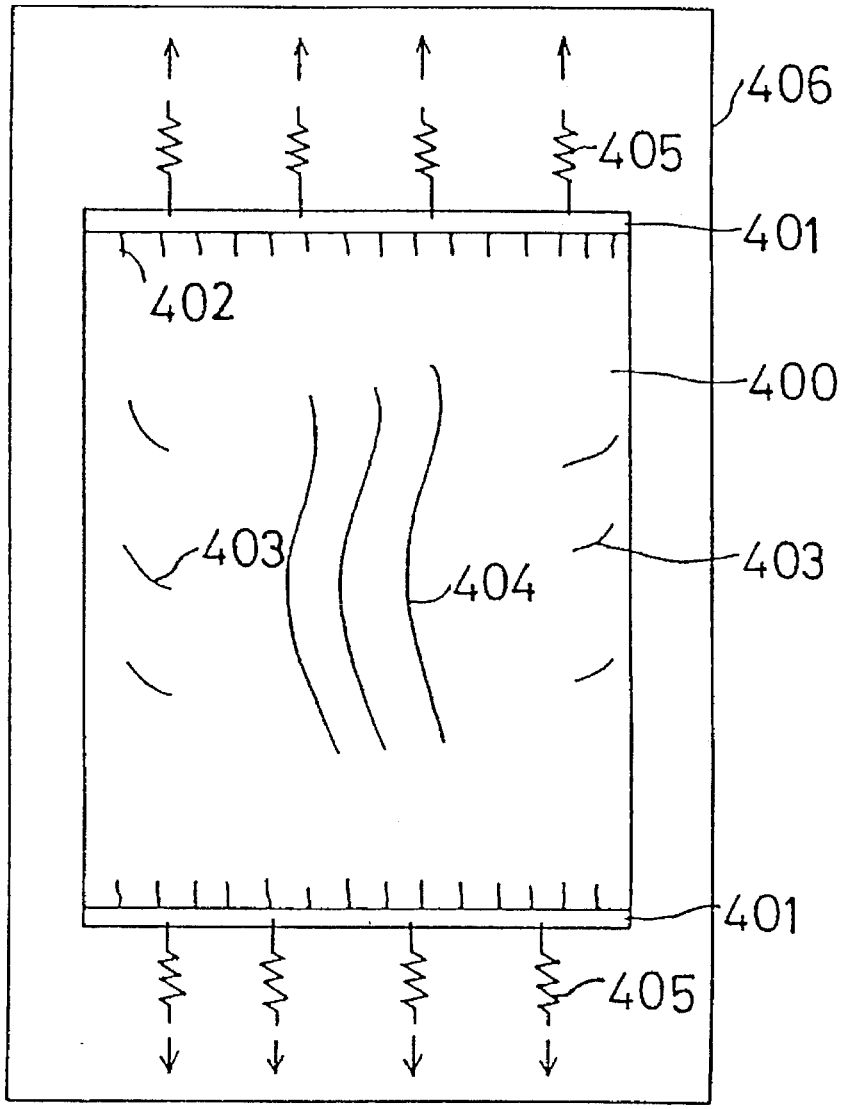
PRIOR ART FIG. 51
FIG. 51 is a plan view of a tension panel according to another prior art.
Figure 52:
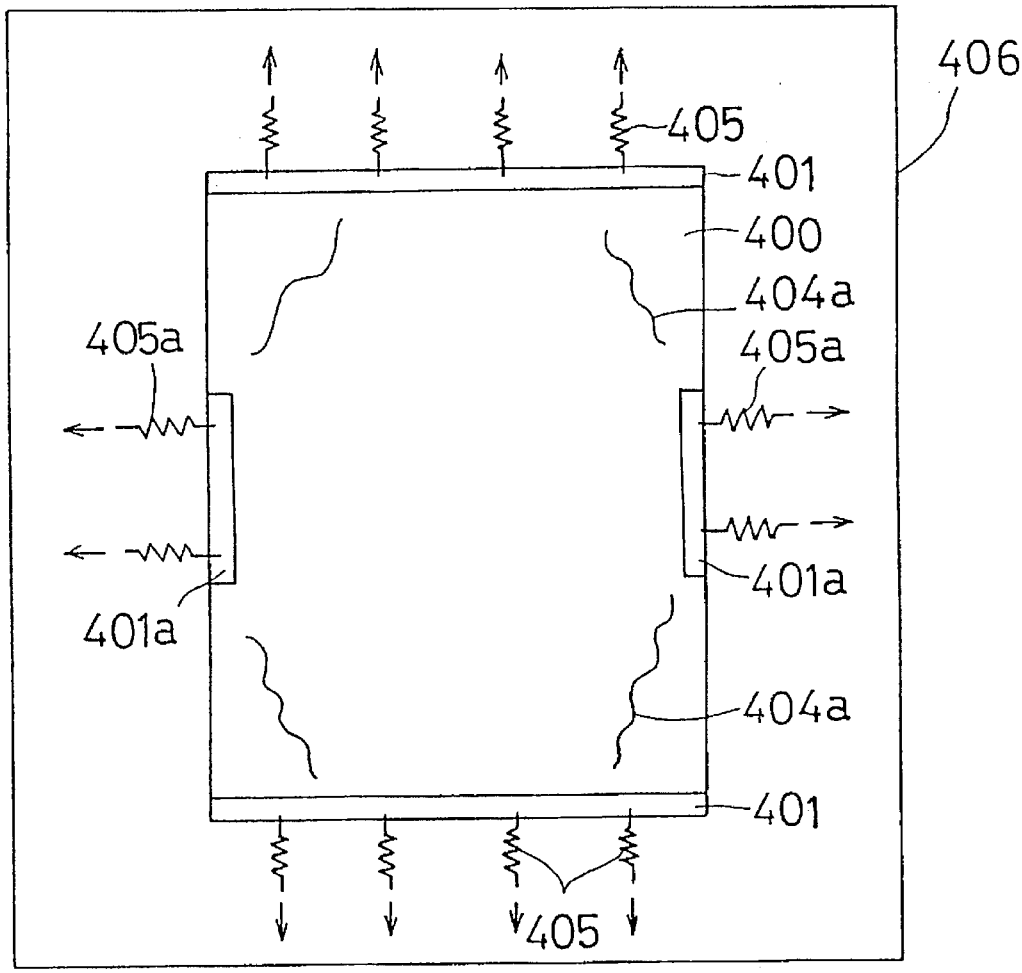
PRIOR ART FIG. 52
FIG. 52 is a plan view of a tension panel according to still another prior art.
Figure 53:
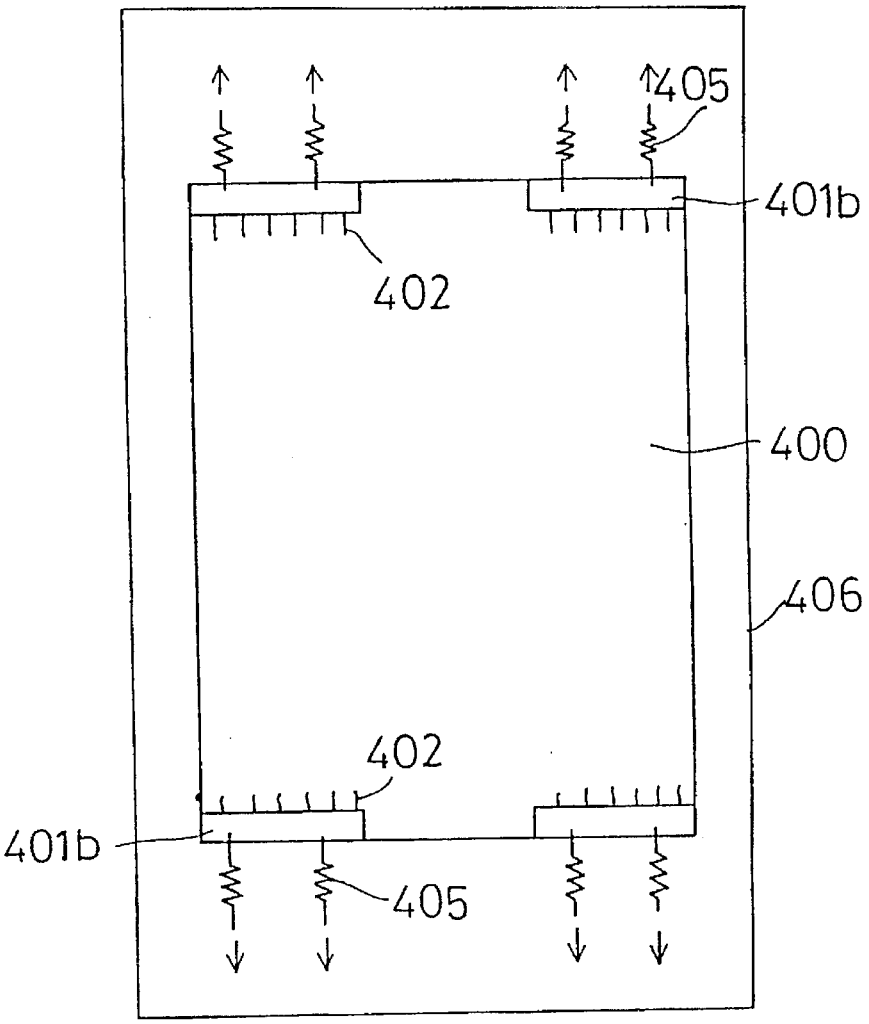
PRIOR ART FIG. 53
FIG. 53 is a plan view of a tension panel according to an improved prior art.

FIG. 48 is a plan view of an L-shaped resilient assembly 310 that is a still further modification of the L-shaped resilient assembly 270 and FIG. 49 is its side view. In this modification, the arms of the L-shaped resilient assembly 310 are respectively provided with leaf springs 311 which can be bent in the directions of arrows and the bending forces of these springs 311 are exerted as tension on a corner of the poster in the extending direction of a bisector which bisects the interior angle of the corner.

When using the L-shaped resilient assemblies 290, 300 and 310 of the foregoing modifications, the projection 235 of the L-shaped retaining member 230 needs to be appropriately arranged such that the retaining member 230 can be hooked over the respective bent parts of the L-shaped resilient assemblies 290, 300 and 310.

In the fifth embodiment, sixth embodiment and their modifications, once a poster is set, the poster is unlikely to come off the frame for the reason that has been described earlier with reference to FIG. 35 in the description of the forth embodiment.

Apart from posters, sheet-like displaying means such as banners can be displayed on the tension panels described above.

While the panel on which a poster or the like is to be displayed is a rectangular panel in integral form in each embodiment, a panel composed of four separate panel corners may be used. When using a panel having separate panel corners, a poster or the like can be suspended in air in a room, for example, in such a way that two panel corners are attached to a ceiling and the other two are attached to a floor. In this case, the L-shaped retaining members and L-shaped resilient assemblies are connected by a long string or alternatively, the stretching and fixing means and retaining means are connected by a long resilient member.

To check creation of creases, display sheets such as posters and banners displayed on the panels according to the embodiments and modifications were left over hour in an environment where temperature was 3° C. and relative humidity was 90%. In this test, no creases, wavy lines and curls were found in the display sheets.

Although the tension exerted on the corner metal fittings or holders by the springs is quite great, say, 1 to 2 kgs (g) or more than 3 kgs (g) in the foregoing embodiments and modifications, the display sheet is not liable to tearing-off for the reason that the corner metal fittings or holders are made in the form of character "L" and the display sheet is supported by the arm faces of the L-shaped members at areas running along the sides of its corners. Tension is exerted on each corner of the display sheet, being dispersed at 90°, which prevents creation of creases and wavy lines even when the tension is great. If such great tension was exerted on each corner of the poster by springs alone, the poster would get creases and wavy lines at its corners.

In the foregoing embodiments and modifications, equal tension is exerted on each corner of the display sheet. However, when the display sheet to be held is pretty heavy, the tension exerted on the upper corners could be greater than the tension exerted on the lower corners, thereby to maintain a balance. The helical springs or leaf springs for imparting tension are not limited to metal springs but could be made from a resin such as POM, PSS or polycarbonate. Springs made from a resin are preferable because they are lightweight and insusceptible to great fatigue and rust.

The holding mechanism of the means for retaining the corners of the display sheet may be achieved by the use of adhesives or the pinching power of springs etc. When using adhesives, the tension exerted on the corners of the display sheet is limited to about 2 to 3 kgs (g). If a tension of 3 kgs (g) or more is exerted on the display sheet, springs having a great pinching power are preferably used.

The poster to be displayed on the tension panel of the invention as the display sheet is not limited to paper sheets but may be resin films. When displaying a poster formed from a resin film, in order to stretch the resin film, it is usually held between two transparent acrylic boards. By the use of the frame according to the invention, a resin film can be displayed, being stretched without using acrylic boards. In this case, back light can be struck to the back of the resin film to enhance aesthetic effects. The retaining means, stretching and fixing means, resilient members and others can be covered by the use of the decorative frame as shown in FIG. 13 and therefore the tension panel of the invention can be used as a both-sided display panel. When displaying two banners the contents of which are different from each other, they may be displayed on the front and back of one panel, or alternatively two tension panels each displaying one banner may be fitted back to back.

According to the foregoing embodiments and their modifications, the strength and direction of the tension exerted on the display sheet can be controlled in accordance with the material of the display sheet as well as environmental conditions such as temperature and humidity, and display sheets of different sizes can be displayed without getting creases, wavy lines and the like. In the foregoing embodiments and modifications, tension is exerted in the extending directions of bisectors each of which bisects the interior angle of each corner of the display sheet, i.e., in the directions of imaginary lines each of which inclines at 45° with respect to one of the sides constituting a corner of the display sheet. However, even if the above inclination angle is 40 to 50° (i.e., each line inclines at 50 to 40° with respect to the other side), not only will the balance of the tension exerted on the display sheet be kept, but also no creases, wavy lines and curls will be created on the display sheet. As the means for exerting tension on the poster, strings or straps made from rubber or a resin having elasticity could be used.

Each member and means disclosed in the foregoing embodiments and modifications has compatibility and therefore, for example, the L-shaped retaining member 230 of the forth embodiment could be used in the second or third embodiment.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A tension panel, comprising:

a frame;

a retaining device affixable to respective corners of a display sheet; and a stretching and fixing assembly, including:

an L-shaped bar formed by two legs joined together to define a bent region of said bar, said legs each having a free end pivotably attached to said frame, said bar being movable from a raised position, through an intermediate position, and to a lowered position in which said bar lies essentially flush with said frame; and a resilient member having one end attached to the bent region of said bar, and another end attached to said retaining device, said member exerting a tensile force on said retaining device when said bar is in the lowered position, the tensile force being directed in a direction along an imaginary line that divides an interior angle of the respective corner into two angles, so as to stretch and fix the display sheet on said frame, whereby when said bar is in the raised position, the tensile force is not exerted; when said bar is in the intermediate position, said bar exhibits an unstable condition; and when said bar is in a position that is between the intermediate position and the lowered position, a component of the tensile force urges said bar into the lowered position.

2. The tension panel defined in claim 1 wherein said retaining device comprises a holder that is stuck to a respective corner of the display sheet.

3. The tension panel defined in claim 1 wherein said retaining device comprises a clip that pinches and holds a respective corner of the display sheet.

4. The tension panel defined in claim 1, wherein said retaining device has an L-shape.

5. The tension panel defined in claim 4, wherein said retaining device comprises a leaf spring.

6. The tension panel defined in claim 1, wherein the imaginary line bisects the interior angle.

7. A tension panel, comprising:

a display sheet comprising one of a poster and a banner;

a frame;

a retaining device affixed to and retaining respective corners of said display sheet; and a stretching and fixing assembly, including:

an L-shaped bar formed by two legs joined together to define a bent region of said bar, said legs each having a free end pivotably attached to said frame, said bar being movable from a raised position, through an intermediate position, and to a lowered position in which said bar lies essentially flush with said frame; and a resilient member having one end attached to the bent region of said bar, and another end attached to said retaining device, said member exerting a tensile force on said retaining device when said bar is in the lowered position, the tensile force being directed in a direction along an imaginary line that divides an interior angle of the respective corner into two angles, so as to stretch and fix said display sheet on said frame, whereby when said bar is in the raised position, the tensile force is not exerted; when said bar is in the intermediate position, said bar exhibits an unstable condition; and when said bar is in a position that is between the intermediate position and the lowered position, a component of the tensile force urges said bar into the lowered position.

* * * * *